US009597900B2

(12) United States Patent
Tanaami et al.

(10) Patent No.: US 9,597,900 B2
(45) Date of Patent: Mar. 21, 2017

(54) PRINTING APPARATUS AND CONTROL METHOD

(71) Applicant: CANON KABUSHIKI KAISHA, Tokyo (JP)

(72) Inventors: Yasufumi Tanaami, Tokyo (JP); Tetsuya Saito, Yokohama (JP); Noriyuki Sugiyama, Kawasaki (JP); Syunichi Kunihiro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/723,629

(22) Filed: May 28, 2015

(65) Prior Publication Data

US 2015/0352866 A1 Dec. 10, 2015

(30) Foreign Application Priority Data

Jun. 4, 2014 (JP) ..... 2014-116205

(51) Int. Cl.
*B41J 13/00* (2006.01)

(52) U.S. Cl.
CPC ..... *B41J 13/0009* (2013.01); *B41J 13/0018* (2013.01)

(58) Field of Classification Search
None
See application file for complete search history.

(56) References Cited

U.S. PATENT DOCUMENTS

| | | | | |
|---|---|---|---|---|
| 4,693,587 | A | 9/1987 | Shigenobu et al. | |
| 5,725,206 | A | 3/1998 | Sugiyama | |
| 5,775,823 | A | 7/1998 | Bekki et al. | |
| 5,915,684 | A | 6/1999 | Nakagawa et al. | |
| 6,454,477 | B1 | 9/2002 | Sugiyama | |
| 2007/0147921 | A1* | 6/2007 | Chae | G03G 15/234 399/401 |
| 2011/0076082 | A1* | 3/2011 | Ouchi | B41J 13/0027 400/583 |

FOREIGN PATENT DOCUMENTS

JP 2000-015881 A 1/2000

OTHER PUBLICATIONS

Machine translation of JP 2000-015881 A. (JP 2000-015881 A was published on Jan. 18, 2000.).*

(Continued)

*Primary Examiner* — Justin Seo
(74) *Attorney, Agent, or Firm* — Fitzpatrick, Cella, Harper & Scinto

(57) ABSTRACT

The present invention provides a printing apparatus. The printing apparatus includes a feeding unit, a pair of rollers configured to nip a printing medium and to convey the printing medium fed by the feeding unit, a printing unit and a control unit. The control unit can execute successive overlapped conveyance in which the pair of rollers nip an overlapping portion between a trailing edge of a preceding printing medium and a leading edge of a succeeding printing medium and convey them. The control unit executes the successive overlapped conveyance at least on condition that printing of the preceding printing medium by the printing unit has ended.

23 Claims, 18 Drawing Sheets

(56) References Cited

OTHER PUBLICATIONS

Tomofumi Nishida et al., U.S. Appl. No. 14/722,379, filed May 27, 2015.
Tomofumi Nishida et al., U.S. Appl. No. 14/623,860, Feb. 17, 2015.
Unpublished copending U.S. Appl. No. 14/623,860, to Tomofumi Nishida et. al., filed Feb. 17, 2015.
Unpublished copending U.S. Appl. No. 14/722,379, to Tomofumi Nishida et. al., filed May 27, 2015.

* cited by examiner

PRINTING APPARATUS AND CONTROL METHOD

BACKGROUND OF THE INVENTION

Field of the Invention

The present invention relates to a printing apparatus.

Description of the Related Art

As a method of increasing the printing speed of a printing apparatus, successive overlapped conveyance of printing media has been proposed. Successive overlapped conveyance indicates a conveyance method of conveying a plurality of printing media while the leading edge of the succeeding printing medium overlaps the trailing edge of the preceding printing medium when images are successively printed on the printing media (for example, Japanese Patent Laid-Open No. 2000-15881). Successive overlapped conveyance makes it possible to further increase the printing speed, as compared with a conveyance method of starting to feed the succeeding printing medium after the end of printing of the preceding medium or a conveyance method of successively conveying the printing media while decreasing the gap between the printing media.

A pair of rollers are generally used to convey a printing medium. The pair of rollers include a driving roller and a driven roller pressed against the driving roller. The pair of rollers nip and convey a printing medium, and the conveyance amount of the printing medium is controlled by controlling the rotation amount of the driving roller.

In successive overlapped conveyance, the pair of rollers nip and convey two printing media. In this case, the thickness of a conveyance target is different from that when one printing medium is nipped and conveyed. Also, the two printing media may slip. Therefore, the conveyance accuracy of the printing media may decrease, resulting in degradation in printing quality.

SUMMARY OF THE INVENTION

The present invention provides a technique of increasing the printing speed while suppressing degradation in printing quality.

According to an aspect of the present invention, there is provided a printing apparatus comprising: a feeding unit configured to feed a printing medium stacked on a stacking unit; a pair of rollers configured to nip the printing medium and to convey the printing medium fed by the feeding unit; a printing unit configured to print on the printing medium conveyed by the pair of rollers; and a control unit configured to control the feeding unit and the conveying unit, wherein the control unit can execute successive overlapped conveyance in which the pair of rollers nip an overlapping portion between a trailing edge of a preceding printing medium and a leading edge of a succeeding printing medium and convey the preceding printing medium and the succeeding printing medium, and the control unit executes the successive overlapped conveyance at least on condition that printing of the preceding printing medium by the printing unit has ended.

Further features of the present invention will become apparent from the following description of exemplary embodiments (with reference to the attached drawings).

DESCRIPTION OF THE EMBODIMENTS

First Embodiment

Figure 1:
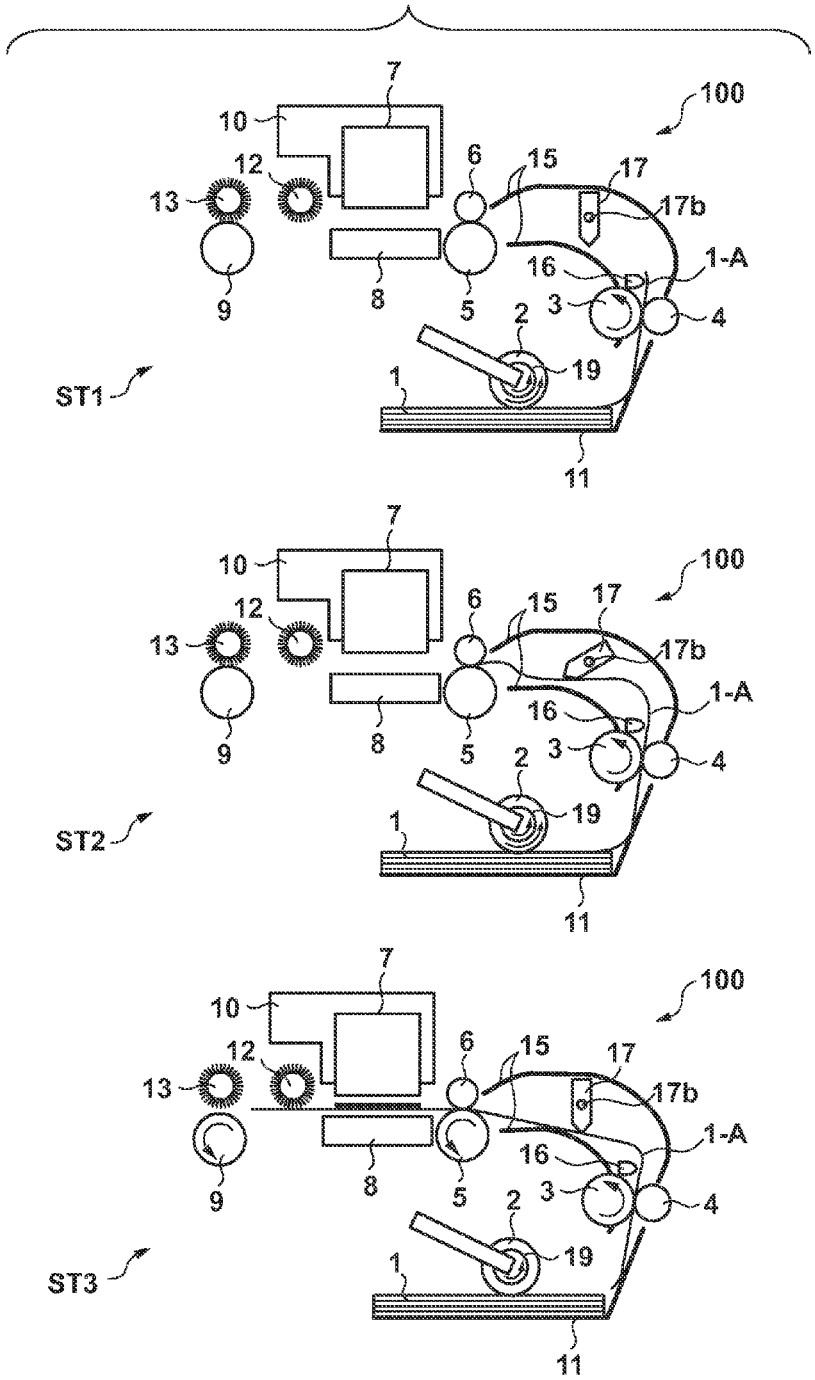
FIG. 1 is a view for explaining the operation of a printing apparatus according to an embodiment of the present invention.
Figure 2:
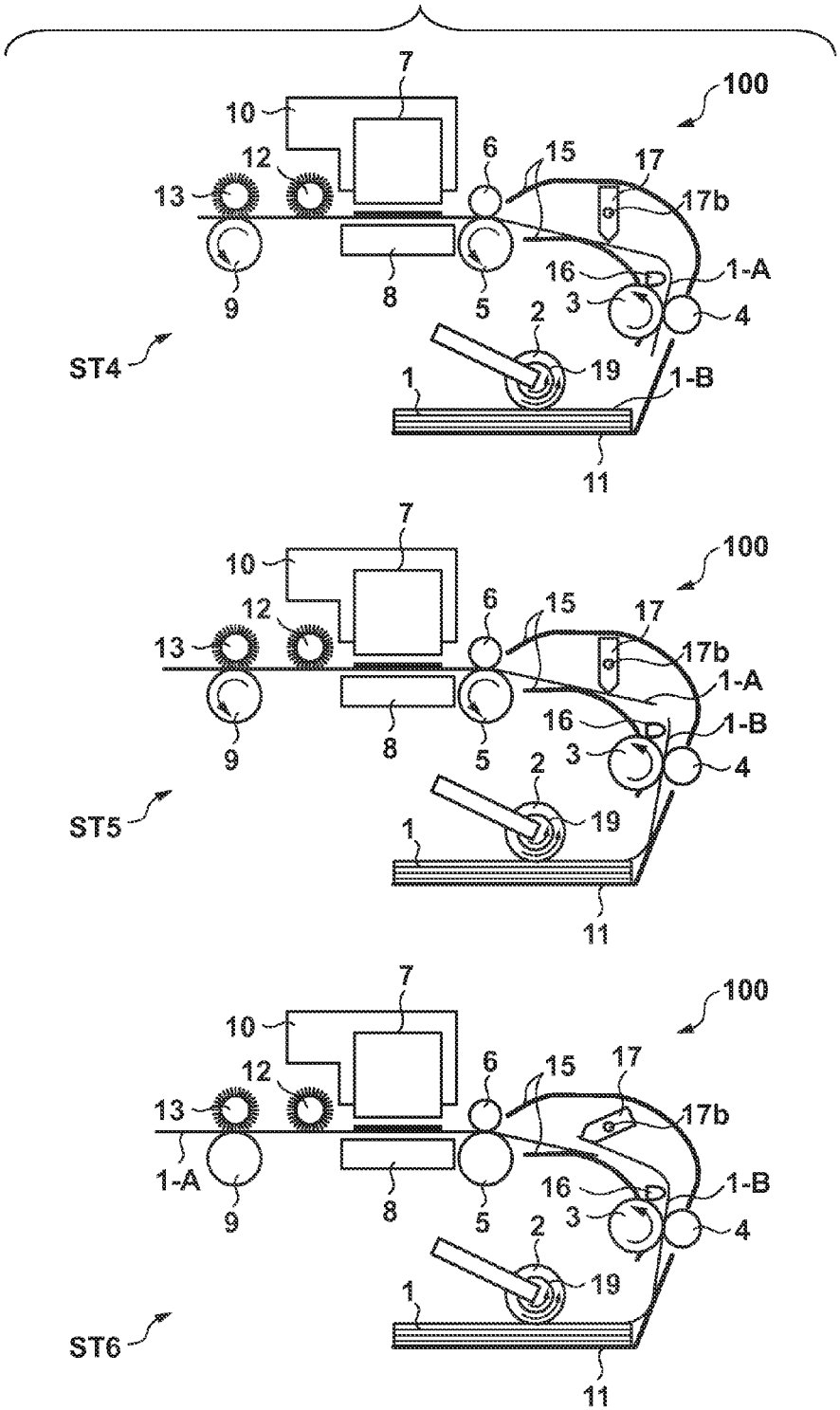
FIG. 2 is a view for explaining the operation of the printing apparatus shown in FIG. 1.
Figure 3:
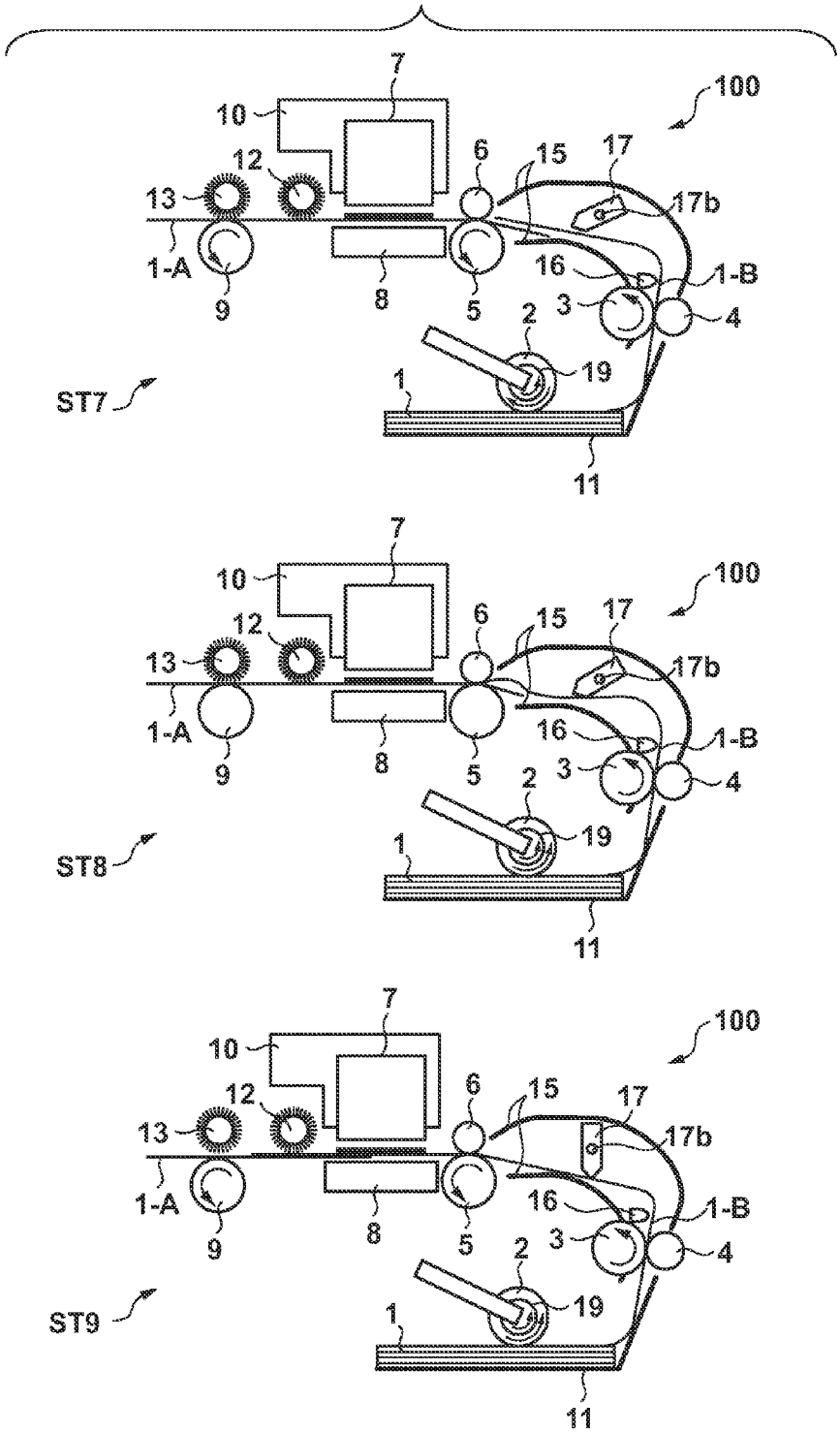
FIG. 3 is a view for explaining the operation of the printing apparatus shown in FIG. 1.

FIGS. 1 to 3 are views for explaining the operation of a printing apparatus 100 according to the embodiment of the present invention, especially, a successive overlapped conveyance operation. FIGS. 1 to 3 schematically show the sectional structure of the printing apparatus 100. In this embodiment, a case in which the present invention is applied to a serial type inkjet printing apparatus will be described. However, the present invention is also applicable to printing apparatuses of other forms.

Note that the term "printing" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans. Also, sheet-like paper is assumed as a "printing medium" in this embodiment, but cloth, plastic film, and the like may be used as printing media. A sheet-like printing medium will be referred to as a printing sheet hereinafter.

Prior to a description of the operation of the printing apparatus 100, the arrangement of the printing apparatus 100 will be described with reference to a state ST1 of FIG. 1. The printing apparatus 100 includes a feeding tray 11 (a stacking unit) on which a plurality of printing sheets 1 can be stacked, a printing unit for printing on the printing sheet 1, and a conveyance apparatus capable of conveying the printing sheet 1 on the feeding tray 11.

The printing unit includes a printhead 7 and a carriage 10. The printhead 7 prints on the printing sheet 1. In this embodiment, the printhead 7 is an inkjet printhead which prints on the printing sheet 1 by discharging ink. A platen 8 which supports the reverse surface of the printing sheet 1 is arranged at a position facing the printhead 7. A carriage 10 incorporates the printhead 7 and moves in a direction intersecting a conveyance direction.

The conveyance apparatus is broadly divided into a feeding mechanism, conveying mechanism, and a discharging mechanism. The feeding mechanism feeds the printing sheet 1 stacked on the feeding tray 11 to the conveying mechanism. The conveying mechanism conveys the fed printing sheet 1 to the discharging mechanism. The discharging mechanism conveys the printing sheet 1 outside the printing apparatus 100. Conveyance of the printing sheet 1 being printed is mainly performed by the conveying mechanism. In this way, the printing sheet 1 is sequentially conveyed by the feeding mechanism, conveying mechanism, and discharging mechanism. The feeding mechanism side will be referred to as the upstream side of the conveyance direction and the discharging mechanism side will be referred to as the downstream side of the conveyance direction.

The feeding mechanism includes a pickup roller 2, a feeding roller 3, and a feeding driven roller 4. The pickup roller 2 abuts against the top printing sheet 1 stacked on the feeding tray 11 to pick it up. The feeding roller 3 feeds the printing sheet 1 picked up by the pickup roller 2 toward the downstream side of the conveyance direction. The feeding driven roller 4 is biased and pressed against the feeding roller 3 by an elastic member (for example, a spring) (not shown) to nip the printing sheet 1 with the feeding roller 3, thereby feeding the printing sheet 1.

Figure 4A:
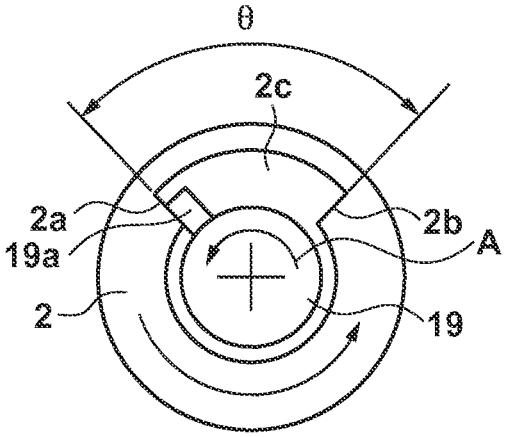
FIGS. 4A and 4B are views for explaining a pickup roller.
Figure 4B:
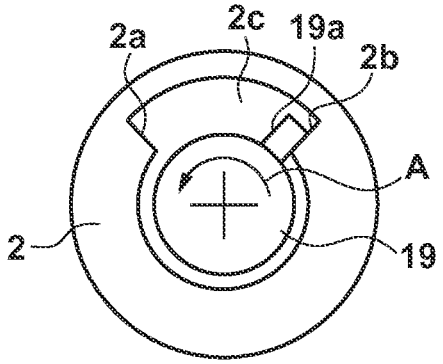

FIGS. 4A and 4B are views for explaining the arrangement of the pickup roller 2. A driving shaft 19 is provided in the pickup roller 2. The driving shaft 19 transmits the driving force of a feeding motor (to be described later) to the pickup roller 2. When picking up the printing sheet 1, the driving shaft 19 and the pickup roller 2 rotate in a direction indicated by an arrow A in FIGS. 4A and 4B. A projection 19*a* is formed in the driving shaft 19. A concave portion 2*c* in which the projection 19*a* fits is formed in the pickup roller 2.

As shown in FIG. 4A, when the projection 19*a* abuts against a first surface 2*a* of the concave portion 2*c* of the pickup roller 2, driving of the driving shaft 19 is transmitted to the pickup roller 2. In this case, when the driving shaft 19 is driven, the pickup roller 2 is also rotated. On the other hand, as shown in FIG. 4B, when the projection 19*a* abuts against a second surface 2*b* of the concave portion 2*c* of the pickup roller 2, driving of the driving shaft 19 is not transmitted to the pickup roller 2. In this case, even if the driving shaft 19 is driven, the pickup roller 2 is not rotated. Also, when the projection 19*a* is formed between the first surface 2*a* and the second surface 2*b* without abutting against the first surface 2*a* or the second surface 2*b*, even if the driving shaft 19 is driven, the pickup roller 2 is not rotated. Although a description will be provided later, when successively feeding the plurality of printing sheets 1 by this mechanism, it is possible to ensure a given gap between the printing sheets 1.

Referring back to FIG. 1, the conveying mechanism includes a conveyance roller 5 and a pinch roller 6. These rollers form a pair of rollers for nipping and conveying the printing sheet 1. The conveyance roller 5 conveys the printing sheet 1 fed by the feeding roller 3 and feeding driven roller 4 to the position facing the printhead 7. The pinch roller 6 is biased and pressed against the conveyance roller 5 by an elastic member (for example, a spring) (not shown) to nip the printing sheet 1 with the conveyance roller 5, thereby conveying the printing sheet 1. In printing, for example, an image is printed on the printing sheet 1 by alternately repeating an operation of conveying the printing sheet 1 by a predetermined amount by the conveyance roller 5 and pinch roller 6, and an operation of moving the carriage 10 and discharging ink by the printhead 7.

A conveyance guide 15 for guiding conveyance of the printing sheet 1 is provided in a conveyance section between a nip portion (to be referred to as a feeding nip portion hereinafter) formed by the feeding roller 3 and feeding driven roller 4 and a nip portion (to be referred to as a conveyance nip portion hereinafter) formed by the conveyance roller 5 and pinch roller 6.

The discharging mechanism includes a discharge roller 9 and spurs 12 and 13. The discharge roller 9 discharges the printing sheet 1 printed by the printhead 7 to the outside of the apparatus. The spurs 12 and 13 rotate while they are in contact with the printing surface of the printing sheet 1 printed by the printhead 7. The spur 13 on the downstream side is biased and pressed against the discharge roller 9 by an elastic member (for example, a spring) (not shown). No discharge roller 9 is arranged at a position facing the spur 12 on the upstream side. The spur 12 is used to prevent the floating of the printing sheet 1, and is also referred to as a pressing spur.

The printing apparatus 100 includes a sheet detection sensor 16. The sheet detection sensor 16 detects the leading edge and trailing edge of the printing sheet 1, and is, for example, an optical sensor. The sheet detection sensor 16 is provided downstream of the feeding roller 3 in the conveyance direction. A sheet pressing lever 17 makes the leading edge of the succeeding printing sheet 1 (to be referred to as the succeeding printing medium or succeeding sheet hereinafter) overlap the trailing edge of the preceding printing sheet 1 (to be referred to as the preceding printing medium or the preceding sheet hereinafter) by pressing the trailing edge. Note that the leading edge and trailing edge of the printing sheet 1 indicate the edge on the downstream side and the edge on the upstream side of the conveyance direction, respectively. The sheet pressing lever 17 is biased by an elastic member (for example, a spring) (not shown) around a rotating shaft 17*b* in a counterclockwise direction in FIG. 1.

An example of the arrangement of a printing system including the control unit of the printing apparatus 100 and an information processing apparatus 214 capable of transmitting printing data to the printing apparatus 100 will be described with reference to FIG. 5.

The printing apparatus 100 includes an MPU 201. The MPU 201 can control the operation of each component of the printing apparatus 100, and performs data processing and the like. As will be described later, the MPU 201 can control conveyance of the printing sheets 1 so that the trailing edge of the preceding sheet and the leading edge of the succeeding sheet overlap each other. A ROM 202 stores data and programs to be executed by the MPU 201. A RAM 203 temporarily stores processing data to be executed by the MPU 201 and printing data received from the information processing apparatus 214. Note that other storage devices can be used instead of the ROM 202 and RAM 203.

A printhead driver 207 drives the printhead 7. A carriage motor driver 208 drives a carriage motor 204 as the driving source of a driving mechanism for moving the carriage 10.

A conveyance motor 205 serves as the driving source of the driving mechanism of the conveyance roller 5 and discharge roller 9. A conveyance motor driver 209 drives the conveyance motor 205.

A feeding motor 206 serves as the driving source of the driving mechanism of the pickup roller 2 and feeding roller 3. A feeding motor driver 210 drives the feeding motor 206.

The MPU 201 controls the printing operation (discharge of ink and movement of the printhead 7) of the printhead 7 via the printhead driver 207 and carriage motor driver 208. The MPU 201 also controls conveyance of the printing sheets 1 via the conveyance motor driver 209 and feeding motor driver 210.

The information processing apparatus 214 is, for example, a personal computer or portable terminal (for example, a smartphone or tablet terminal), and functions as the host computer of the printing apparatus 100. The information processing apparatus 214 includes a CPU 214*a*, a storage device 214*b*, and an I/F unit (interface unit) 214*c*. The CPU 214*a* executes a program stored in the storage device 214*b*. The storage device 214*b* is a RAM, a ROM, a hard disk, or the like, and stores a program to be executed by the CPU 214*a* and various data. The storage device 214*b* stores a printer driver 2141 for controlling the printing apparatus 100. By executing the printer driver 2141, the information processing apparatus 214 can generate printing data. The information processing apparatus 214 and printing apparatus 100 can transmit and receive data via the I/F unit 214*c* and an I/F unit 213.

<Example of Successive Overlapped Conveyance>

A successive overlapped conveyance operation will be described in time series with reference to FIGS. 1 to 3. When the information processing apparatus 214 transmits printing data via the I/F unit 213, the printing data is processed by the MPU 201, and then loaded into the RAM 203. The MPU 201 starts a printing operation based on the loaded data.

A description will be provided with reference to the state ST1 of FIG. 1. First, the feeding motor driver 210 drives the feeding motor 206. This rotates the pickup roller 2. At this stage, the feeding motor 206 is driven to rotate at a relatively low speed. In this example, the pickup roller 2 is exemplarily rotated at 7.6 inches/sec.

When the pickup roller 2 rotates, the top printing sheet (a preceding sheet 1-A) stacked on the feeding tray 11 is picked up. The preceding sheet 1-A picked up by the pickup roller 2 is conveyed by the feeding roller 3 rotating in the same direction as that of the pickup roller 2. The feeding motor 206 also drives the feeding roller 3. This embodiment will be described by using an arrangement including the pickup roller 2 and the feeding roller 3. However, an arrangement including only a feeding roller for feeding the printing sheet stacked on the stacking unit may be adopted.

When the sheet detection sensor 16 provided on the downstream side of the feeding roller 3 detects the leading edge of the preceding sheet 1-A, the feeding motor 206 is driven to rotate at a relatively high speed. In this example, the pickup roller 2 and feeding roller 3 exemplarily rotate at 20 inches/sec.

A description will be provided with reference to a state ST2 of FIG. 1. When the feeding roller 3 is continuously rotated, the leading edge of the preceding sheet 1-A rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveyance roller 5 and pinch roller 6. At this time, the conveyance roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion. The skew correction operation will also be referred to as a registration adjustment operation.

A description will be provided with reference to a state ST3 of FIG. 1. Upon end of the skew correction operation of the preceding sheet 1-A, the conveyance motor 205 is driven to start rotation of the conveyance roller 5. The conveyance roller 5 conveys the sheet at, for example, 15 inches/sec. The preceding sheet 1-A is aligned with the position facing the printhead 7. This position is the start position of printing by the printhead 7, and may be referred to as an alignment position. After the alignment operation, a printing operation is performed by discharging ink from the printhead 7 based on the printing data.

Note that the alignment operation is performed by making the leading edge of the printing sheet 1 abut against the conveyance nip portion to temporarily position the printing sheet 1 at the position of the conveyance roller 5, and controlling the rotation amount of the conveyance roller 5 with reference to the position of the conveyance roller 5.

The printing apparatus 100 of this embodiment is a serial type printing apparatus in which the carriage 10 mounts the printhead 7. The printing operation of the printing sheet 1 is performed by repeating a conveyance operation and an image forming operation. The conveyance operation is an operation of intermittently conveying the printing sheet by a predetermined amount using the conveyance roller 5. The image forming operation is an operation of discharging ink from the printhead 7 while moving the carriage 10 incorporating the printhead 7 when the conveyance roller 5 stops.

When alignment of the preceding sheet 1-A is performed, the feeding motor 206 is switched to low-speed driving again. That is, the pickup roller 2 and feeding roller 3 rotate at 7.6 inches/sec. While the conveyance roller 5 intermittently conveys the printing sheet 1 by the predetermined amount, the feeding motor 206 also intermittently drives the feeding roller 3. That is, while the conveyance roller 5 rotates, the feeding roller 3 also rotates. While the conveyance roller 5 stops, the feeding roller 3 also stops. The rotation speed of the feeding roller 3 is lower than that of the conveyance roller 5. Consequently, the printing sheet 1 is stretched between the conveyance roller 5 and the feeding roller 3. The feeding roller 3 is rotated together with the printing sheet 1 conveyed by the conveyance roller 5.

When the feeding motor 206 is intermittently driven, the driving shaft 19 also rotates. As described above, however, the rotation speed of the pickup roller 2 is lower than that of the conveyance roller 5. Consequently, the pickup roller 2 is rotated together with the printing sheet 1 conveyed by the conveyance roller 5. The pickup roller 2 thus rotates ahead of the driving shaft 19. More specifically, the projection 19*a* of the driving shaft 19 is spaced apart from the first surface 2*a* and abuts against the second surface 2*b*. Therefore, the second printing sheet (a succeeding sheet 1-B) is not picked up soon after the trailing edge of the preceding sheet 1-A passes through the pickup roller 2. After the preceding sheet 1-A passes through the feeding nip portion and the driving shaft 19 is driven for a predetermined time, the projection 19*a* abuts against the first surface 2*a*. The rotation of the driving shaft 19 is transmitted to the pickup roller 2, and the pickup roller 2 starts to rotate. This operation generates a time lag until the succeeding sheet 1-B is picked up.

A description will be provided with reference to a state ST4 of FIG. 2. In the state ST4, a state in which the pickup roller 2 starts to rotate, and picks up the succeeding sheet 1-B is shown. Due to a factor such as the responsiveness of the sensor, the sheet detection sensor 16 requires a predetermined interval or more between the successive printing sheets 1 to detect the edges of the printing sheets 1 more correctly. As described above, in this embodiment, with the arrangement including the driving shaft 19 and pickup roller 2, a time lag is generated until the succeeding sheet 1-B is picked up and the interval is ensured.

That is, it is necessary to separate the leading edge of the succeeding sheet 1-B from the trailing edge of the preceding sheet 1-A by a predetermined distance to provide a predetermined time interval from when the sheet detection sensor 16 detects the trailing edge of the preceding sheet 1-A until it detects the leading edge of the succeeding sheet 1-B. To achieve this, the angle of the concave portion 2*c* of the pickup roller 2 is set to about 70°.

A description will be provided with reference to a state ST5 of FIG. 2. The succeeding sheet 1-B picked up by the pickup roller 2 is conveyed by the feeding roller 3. At this time, the preceding sheet 1-A undergoes an image forming operation by the printhead 7 based on the printing data. When the sheet detection sensor 16 detects the leading edge of the succeeding sheet 1-B, the feeding motor 206 is switched to high-speed driving again. That is, the pickup roller 2 and feeding roller 3 rotate at 20 inches/sec.

A description will be provided with reference to a state ST6 of FIG. 2. The sheet pressing lever 17 presses the trailing edge of the preceding sheet 1-A downward, as shown in the state ST5 of FIG. 2. The succeeding sheet 1-B is moved at a speed higher than that at which the preceding sheet 1-A moves downstream by the printing operation. This makes it possible to form a state in which the leading edge of the succeeding sheet 1-B overlaps the trailing edge of the preceding sheet 1-A (the state ST6 of FIG. 2). Since the preceding sheet 1-A undergoes the printing operation based on the printing data, it is intermittently conveyed by the conveyance roller 5. On the other hand, after the sheet detection sensor 16 detects the leading edge of the succeeding sheet 1-B, the succeeding sheet 1-B can catch up with the preceding sheet 1-A by continuously rotating the feeding roller 3 at 20 inches/sec.

A description will be provided with reference to a state ST7 of FIG. 3. After forming an overlap state in which the leading edge of the succeeding sheet 1-B overlaps the trailing edge of the preceding sheet 1-A, the succeeding sheet 1-B is conveyed by the feeding roller 3 until the leading edge of the succeeding sheet 1-B stops at a predetermined position upstream of the conveyance nip portion, and then stands by.

The position of the leading edge of the succeeding sheet 1-B is calculated from the rotation amount of the feeding roller 3 after the sheet detection sensor 16 detects the leading edge of the succeeding sheet 1-B, and controlled based on the calculation result. At this time, the preceding sheet 1-A undergoes an image forming operation based on the printing data by the printhead 7.

A description will be provided with reference to a state ST8 of FIG. 3. When the conveyance roller 5 stops to perform the image forming operation of the preceding sheet 1-A (in this example, the conveyance roller 5 stops to perform the image forming operation of the last row), the feeding roller 3 is driven. This makes the leading edge of the printing sheet 1-B abut against the conveyance nip portion, thereby performing the skew correction operation of the succeeding sheet 1-B.

A description will be provided with reference to a state ST9 of FIG. 3. When the image forming operation of the preceding sheet 1-A ends, it is possible to perform alignment of the succeeding sheet 1-B while keeping the state in which the succeeding sheet 1-B overlaps the preceding sheet 1-A by rotating the conveyance roller 5 by a predetermined amount. The printing operation of the succeeding sheet 1-B starts based on the printing data. When the succeeding sheet 1-B is intermittently conveyed for the printing operation, the preceding sheet 1-A is also intermittently conveyed, and is finally discharged outside the printing apparatus by the discharge roller 9.

When alignment of the succeeding sheet 1-B is performed, the feeding motor 206 is switched to low-speed driving again. That is, the pickup roller 2 and feeding roller 3 rotate at 7.6 inches/sec. If there is printing data even after the succeeding sheet 1-B, the process returns to the state ST4 of FIG. 2 to pick up the third printing sheet.

As described above, it is possible to continuously perform a printing operation for the plurality of printing sheets 1 while performing successive overlapped conveyance.

Figure 6A:
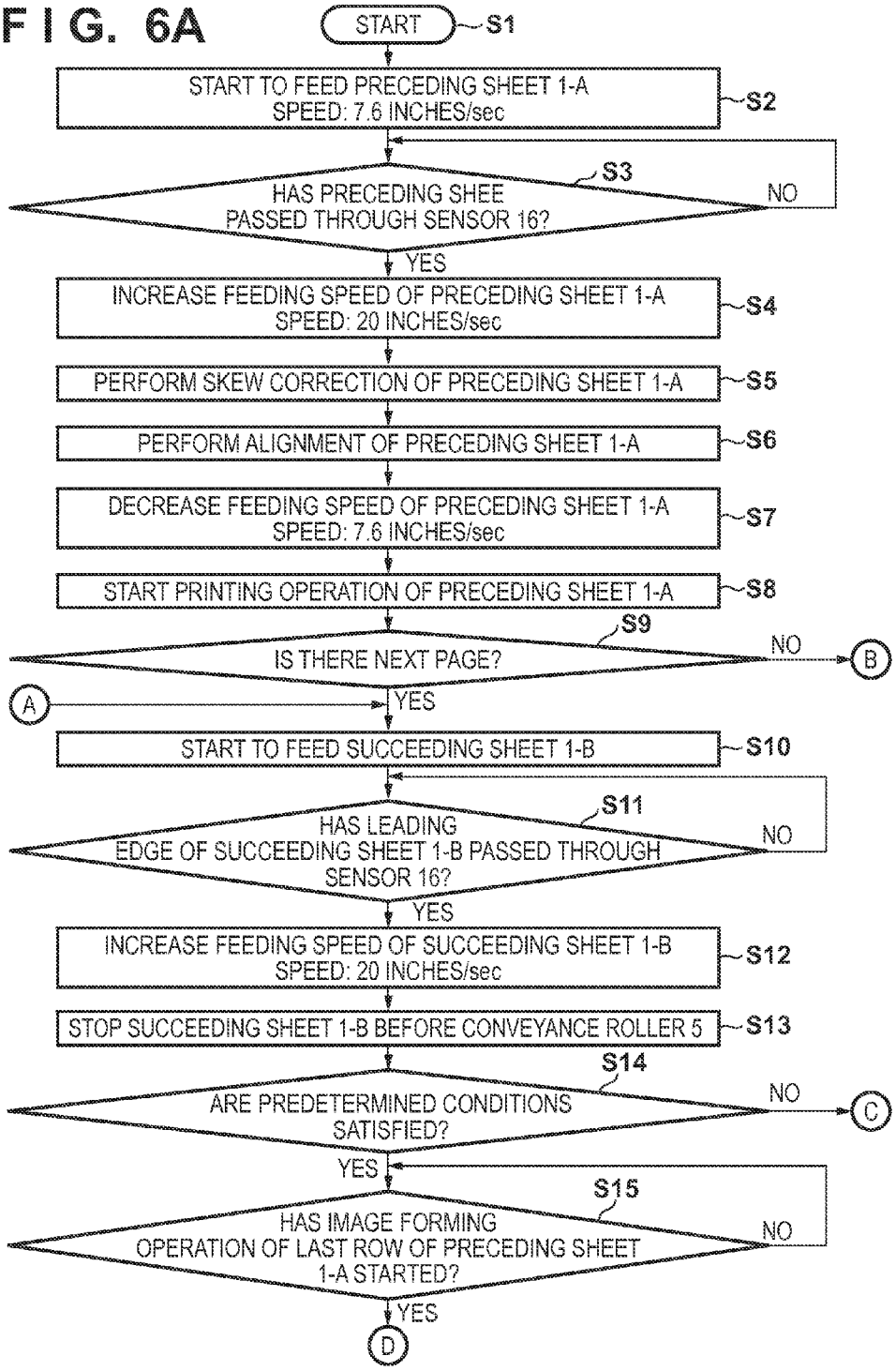
FIGS. 6A and 6B are flowcharts illustrating an example of processing executed by the control unit of the printing apparatus shown in FIG. 1.
Figure 6B:
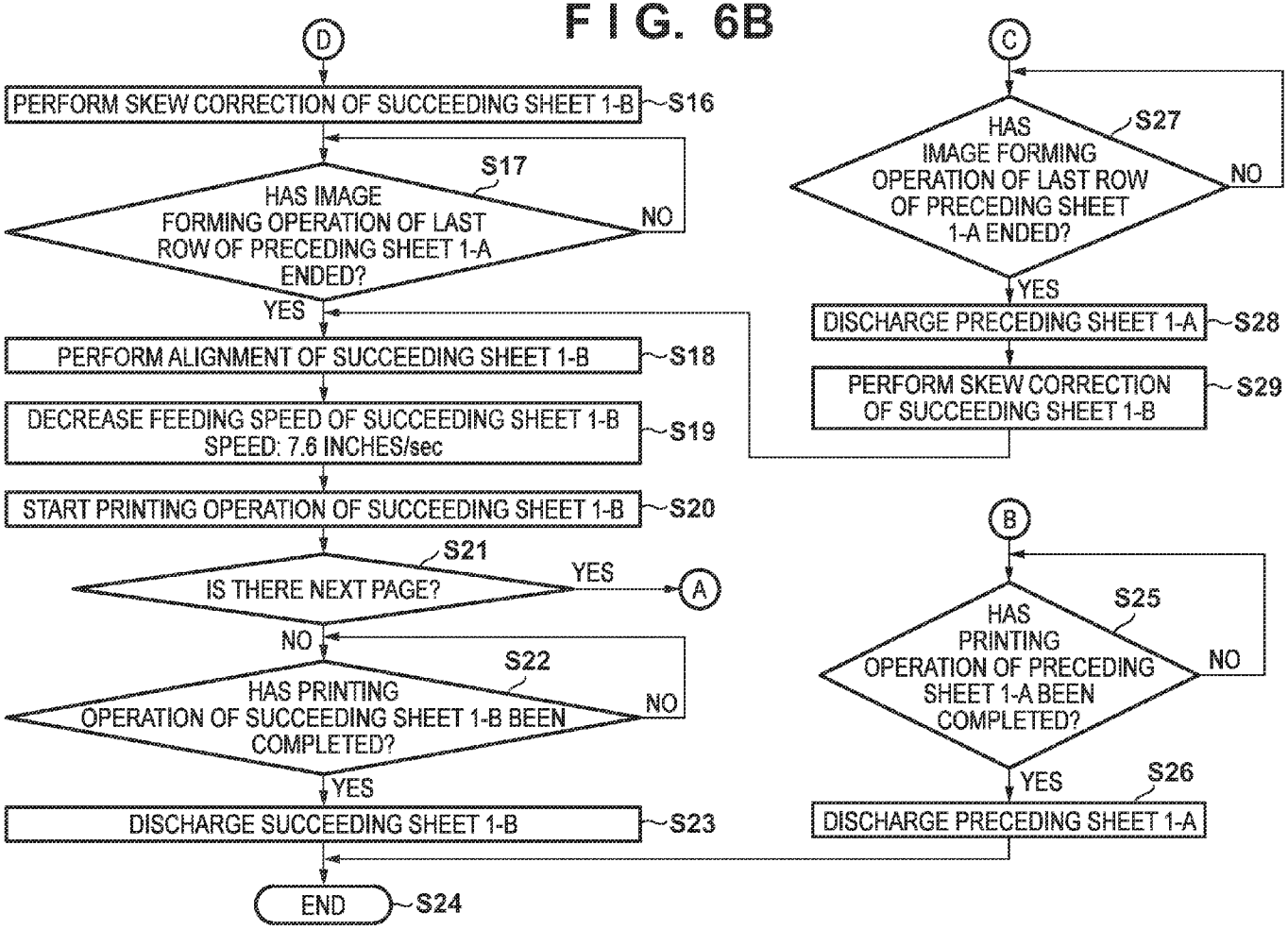

An example of processing by the MPU 201 to execute successive overlapped conveyance described above will be explained. FIGS. 6A and 6B are flowcharts illustrating successive overlapped conveyance processing executed by the MPU 201.

In step S1, when the information processing apparatus 214 transmits a printing start instruction via the I/F unit 213, a printing operation starts. In step S2, the feeding operation of the preceding sheet 1-A starts. More specifically, the feeding motor 206 is driven at low speed. The pickup roller 2 rotates at 7.6 inches/sec. The pickup roller 2 picks up the preceding sheet 1-A, and the feeding roller 3 feeds the preceding sheet 1-A toward the printhead 7.

In step S3, the sheet detection sensor 16 detects the leading edge of the preceding sheet 1-A. When the sheet detection sensor 16 detects the leading edge of the preceding sheet 1-A, the feeding motor 206 is switched to high-speed driving in step S4. That is, the pickup roller 2 and feeding roller 3 rotate at 20 inches/sec. In step S5, by controlling the rotation amount of the feeding roller 3 after the sheet detection sensor 16 detects the leading edge of the preceding sheet 1-A, the leading edge of the preceding sheet 1-A is made to abut against the conveyance nip portion to perform the skew correction operation of the preceding sheet 1-A.

In step S6, alignment of the preceding sheet 1-A is performed based on the printing data. That is, the preceding sheet 1-A is conveyed to a printing start position with reference to the position of the conveyance roller 5 based on the printing data by controlling the rotation amount of the conveyance roller 5. In step S7, the feeding motor 206 is switched to low-speed driving. In step S8, a printing operation starts when the printhead 7 discharges ink to the preceding sheet 1-A.

More specifically, the printing operation of the preceding sheet 1-A is performed by repeating a conveyance operation of intermittently conveying the preceding sheet 1-A by the conveyance roller 5 and an image forming operation (ink discharge operation) of discharging ink from the printhead 7 by moving the carriage 10. The feeding motor 206 is intermittently driven at low speed in synchronization with the operation of intermittently conveying the preceding sheet 1-A by the conveyance roller 5. That is, the pickup roller 2 and feeding roller 3 intermittently rotate at 7.6 inches/sec.

In step S9, it is determined whether there is printing data of the next page. If there is no printing data of the next page, the process advances to step S25. Upon completion of the printing operation of the preceding sheet 1-A in step S25, the preceding sheet 1-A is discharged in step S26, thereby terminating the printing operation.

If there is printing data of the next page, the feeding operation of the succeeding sheet 1-B starts in step S10. More specifically, the pickup roller 2 picks up the succeeding sheet 1-B, and the feeding roller 3 feeds the succeeding sheet 1-B toward the printhead 7. The pickup roller 2 rotates at 7.6 inches/sec. As described above, since the large concave portion 2*c* of the pickup roller 2 is provided with respect to the projection 19*a* of the driving shaft 19, the succeeding sheet 1-B is fed while having a predetermined interval with respect to the trailing edge of the preceding sheet 1-A.

In step S11, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S12. That is, the pickup roller 2 and feeding roller 3 rotate at 20 inches/sec. In step S13, by controlling the rotation amount of the feeding roller 3 after the sheet detection sensor 16 detects the leading edge of the succeeding sheet 1-B, the succeeding sheet 1-B is conveyed so that its leading edge is at a position a predetermined amount before the conveyance nip portion. The preceding sheet 1-A is intermittently conveyed based on the printing data. Continuously driving the feeding motor 206 at high speed forms the overlap state in which the leading edge of the succeeding sheet 1-B overlaps the trailing edge of the preceding sheet 1-A.

In step S14, it is determined whether predetermined conditions are satisfied. The predetermined conditions are conditions for determining the skew correction state of the succeeding sheet 1-B (whether to execute successive overlapped conveyance). Details will be described later.

If the predetermined conditions are satisfied, it is determined in step S15 whether the image forming operation of the last row of the preceding sheet 1-A has started. If it is determined that the image forming operation of the last row of the preceding sheet 1-A has started, the process advances to step S16; otherwise, the process stands by until the image forming operation starts. In step S16, the leading edge of the succeeding sheet 1-B is made to abut against the conveyance nip portion while keeping the overlap state, thereby performing the skew correction operation of the succeeding sheet 1-B. If it is determined in step S17 that the image forming operation of the last row of the preceding sheet 1-A has ended, in step S18 the preceding printing sheet 1-A and the succeeding printing sheet 1-B are conveyed while keeping the overlap state, thereby performing alignment of the succeeding sheet 1-B. That is, the preceding sheet 1-A and the succeeding sheet 1-B are nipped and conveyed while the overlapping portion between the trailing edge of the preceding sheet 1-A and the leading edge of the succeeding sheet 1-B is nipped by the conveyance nip portion.

If it is determined in step S14 that the predetermined conditions are not satisfied, the overlap state is canceled to perform alignment of the succeeding sheet 1-B. More specifically, if it is determined in step S27 that the image forming operation of the last row of the preceding sheet 1-A has ended, the discharge operation of the preceding sheet 1-A is performed in step S28. During this operation, the feeding motor 206 is not driven, and thus the succeeding sheet 1-B stops while its leading edge is at the position the predetermined amount before the conveyance nip portion. Since the preceding sheet 1-A is discharged, the overlap state is canceled. In step S29, the leading edge of the succeeding sheet 1-B is made to abut against the conveyance nip portion to perform the skew correction operation of the succeeding sheet 1-B. In step S18, alignment of the succeeding sheet 1-B is performed. In this way, the preceding sheet and the succeeding sheet are nipped and conveyed without making them overlap each other.

In step S19, the feeding motor 206 is switched to low-speed driving. In step S20, a printing operation starts by discharging ink from the printhead 7 to the succeeding sheet 1-B. More specifically, the printing operation of the succeeding sheet 1-B is performed by repeating a conveyance operation of intermittently conveying the succeeding sheet 1-B by the conveyance roller 5 and an image forming operation (ink discharge operation) of discharging ink from the printhead 7 by moving the carriage 10. The feeding motor 206 is intermittently driven at low speed in synchronization with the operation of intermittently conveying the succeeding sheet 1-B by the conveyance roller 5. That is, the pickup roller 2 and feeding roller 3 intermittently rotate at 7.6 inches/sec.

In step S21, it is determined whether there is printing data of the next page. If there is printing data of the next page, the process returns to step S10. If there is no printing data of the next page, when the image forming operation of the succeeding sheet 1-B is complete in step S22, the discharge operation of the succeeding sheet 1-B is performed in step S23 and the printing operation ends in step S24.

Figure 7:
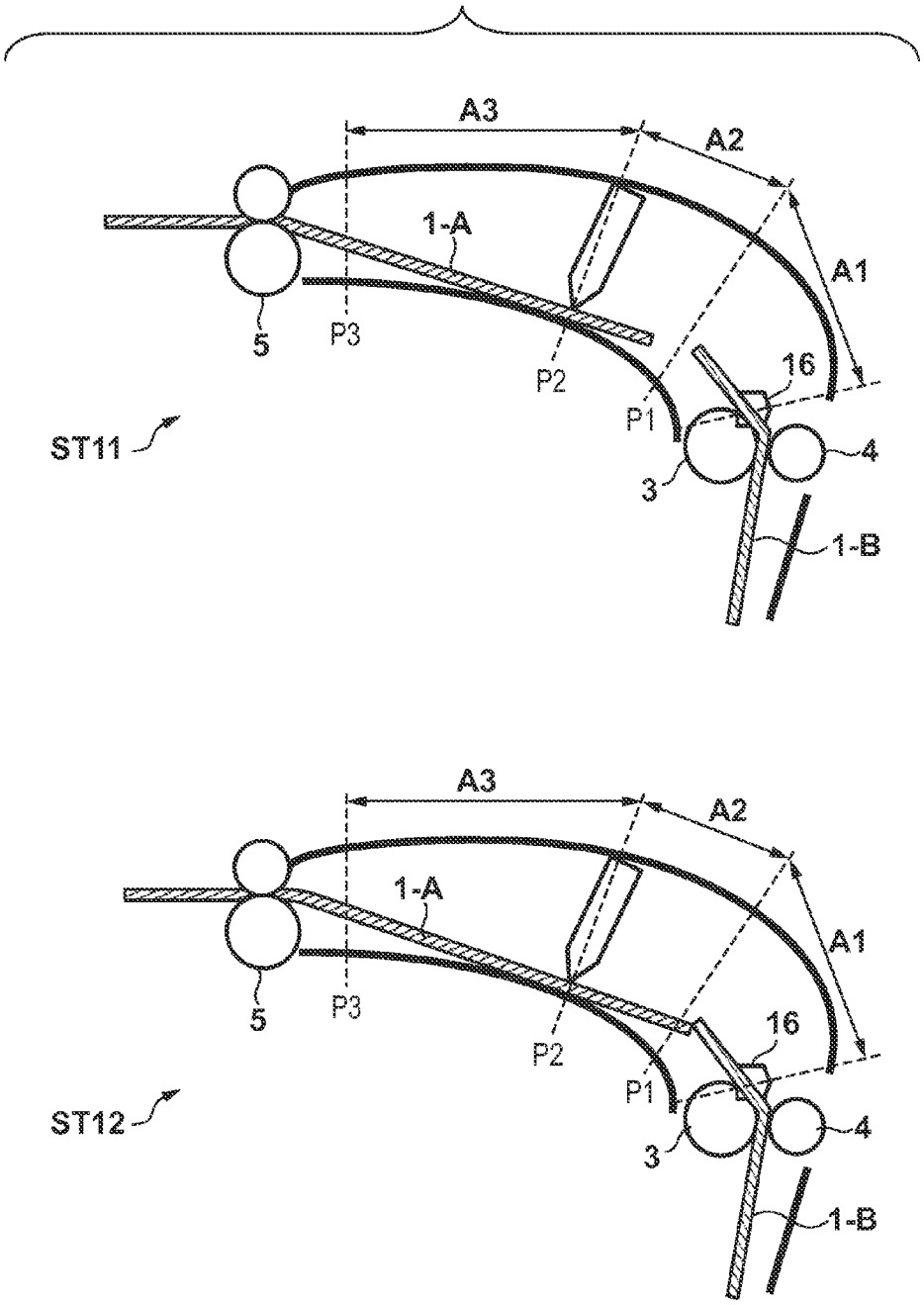
FIG. 7 is a view for explaining an operation of making a succeeding sheet overlap a preceding sheet.
Figure 8:
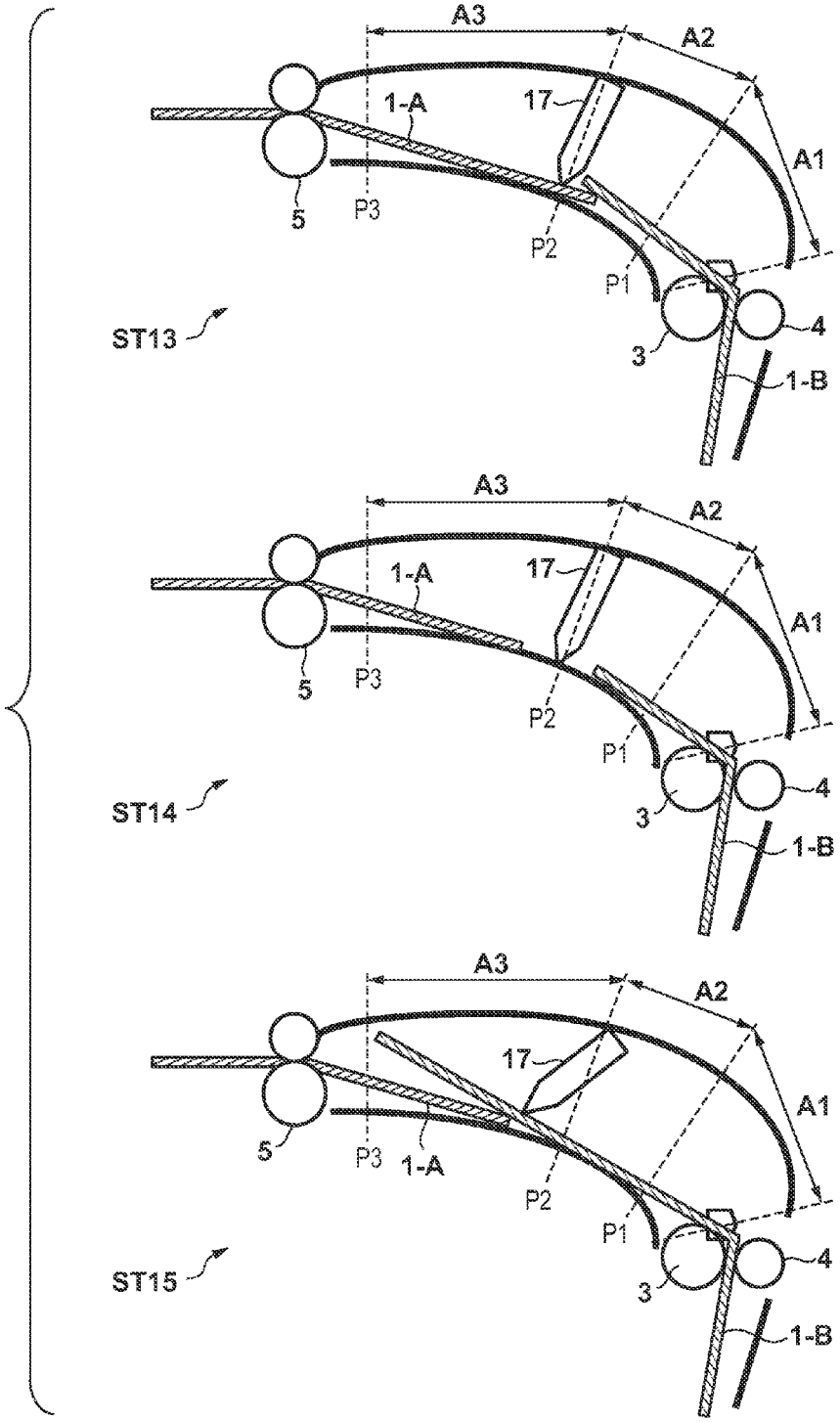
FIG. 8 is a view for explaining the operation of making the succeeding sheet overlap the preceding sheet.

The operation, described in steps S12 and S13 of FIG. 6A, of forming the overlap state in which the leading edge of the succeeding sheet 1-B overlaps the trailing edge of the preceding sheet 1-A will be explained. FIGS. 7 and 8 are views for explaining the operation of making the succeeding sheet 1-B overlap the preceding sheet 1-A according to this embodiment. FIGS. 7 and 8 are enlarged views each showing a portion between the feeding nip portion formed by the feeding roller 3 and feeding driven roller 4 and the conveyance nip portion formed by the conveyance roller 5 and pinch roller 6.

Three states in a process of conveying the printing sheets 1 by the conveyance roller 5 and feeding roller 3 will be sequentially described. The first state in which an operation of making the succeeding sheet 1-B chase the preceding sheet 1-A is performed will be described with reference to states ST11 and ST12 of FIG. 7. The second state in which an operation of making the succeeding sheet 1-B overlap the preceding sheet 1-A is performed will be described with reference to states ST13 and ST14 of FIG. 8. The third state in which it is determined whether to perform the skew correction operation of the succeeding sheet 1-B while keeping the overlap state will be described with reference to a state ST15 of FIG. 8.

In the state ST11 of FIG. 7, the feeding roller 3 is controlled to convey the succeeding sheet 1-B, and the sheet detection sensor 16 detects the leading edge of the succeeding sheet 1-B. A section from the sheet detection sensor 16 to a position P1 at which the succeeding sheet 1-B can be made to overlap the preceding sheet 1-A is defined as a first section A1. In the first section A1, an operation of making the leading edge of the succeeding sheet 1-B chase the trailing edge of the preceding sheet 1-A is performed. The position P1 is decided based on the arrangement of the mechanism.

In the first state, the chasing operation may stop in the first section A1. If, as shown in the state ST12 of FIG. 7, the leading edge of the succeeding sheet 1-B passes the trailing edge of the preceding sheet 1-A before the position P1, the operation of making the succeeding sheet 1-B overlap the preceding sheet 1-A is not performed.

In the state ST13 of FIG. 8, a section from the position P1 to a position P2 at which the sheet pressing lever 17 is provided is defined as a second section A2. In the second section A2, the operation of making the succeeding sheet 1-B overlap the preceding sheet 1-A is performed.

In the second state, the operation of making the succeeding sheet overlap the preceding sheet may stop in the second section A2. If, as shown in the state ST14 of FIG. 8, the leading edge of the succeeding sheet 1-B cannot catch up with the trailing edge of the preceding sheet 1-A within the second section A2, it is impossible to perform the operation of making the succeeding sheet 1-B overlap the preceding sheet 1-A.

In the state ST15 of FIG. 8, a section from the above-described position P2 to a position P3 is defined as a third section A3. The position P3 is the position of the leading edge of the succeeding sheet 1-B when the succeeding sheet 1-B stops in step S13 of FIG. 6A. While the succeeding sheet 1-B overlaps the preceding sheet 1-A, the succeeding sheet 1-B is conveyed so that its leading edge reaches the position P3. In the third section A3, it is determined whether to perform alignment of the succeeding sheet 1-B by making it abut against the conveyance nip portion while keeping the overlap state. That is, it is determined whether to perform alignment of the succeeding sheet by executing a skew correction operation while keeping the overlap state or to perform alignment of the succeeding sheet by canceling the overlap state and performing a skew correction operation.

Figure 9:
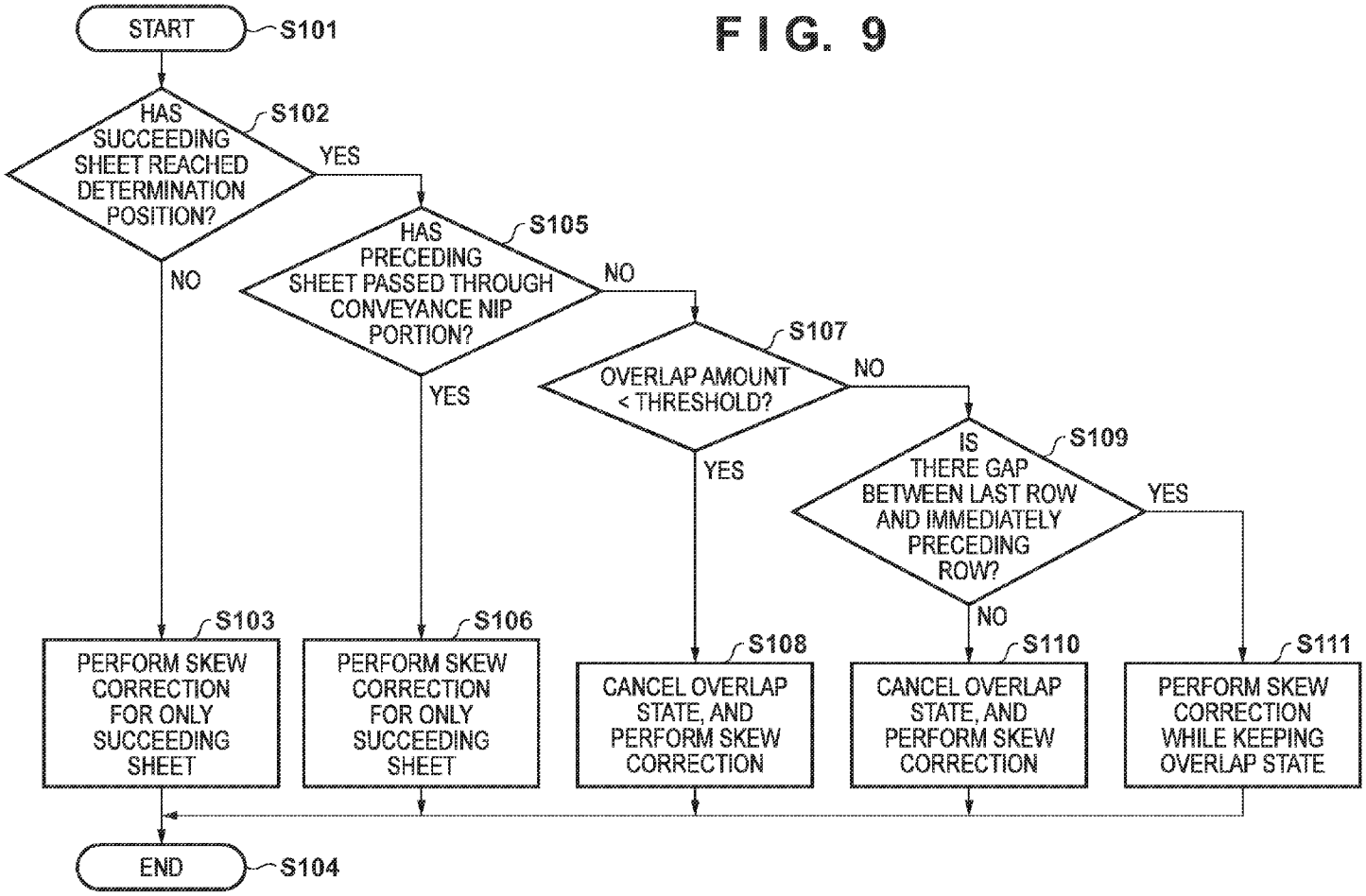
FIG. 9 is a flowchart illustrating an example of processing executed by the control unit of the printing apparatus shown in FIG. 1.

FIG. 9 is a flowchart for explaining the skew correction operation of the succeeding sheet according to this embodiment. The processing of determining whether the predetermined conditions are satisfied, which has been explained in step S14 of FIG. 6A, will be described.

The operation of determining whether to perform the first skew correction operation or the second skew correction operation will be described. The first skew correction operation is an operation of performing skew correction by making the leading edge of the succeeding sheet 1-B abut against the conveyance nip portion while keeping the overlap state between the preceding sheet 1-A and the succeeding sheet 1-B. The second skew correction operation is an operation of performing skew correction by canceling the overlap state between the preceding sheet 1-A and the succeeding sheet 1-B and then making the leading edge of the succeeding sheet 1-B abut against the conveyance nip portion.

In step S101, the operation starts. In step S102, it is determined whether the leading edge of the succeeding sheet 1-B has reached a determination position (the position P3 in the state ST15 of FIG. 8). If the leading edge of the succeeding sheet 1-B has not reached the determination position (NO in step S102), it is uncertain whether the leading edge of the succeeding sheet 1-B abuts against the conveyance nip portion by conveying the succeeding sheet 1-B by a predetermined amount. Thus, a skew correction operation for only the succeeding sheet is decided (step S103), thereby terminating the determination operation (step S104). That is, after the trailing edge of the preceding sheet 1-A passes through the conveyance nip portion, only the succeeding sheet 1-B is made to abut against the conveyance nip portion to perform a skew correction operation, and then alignment of only the succeeding sheet 1-B is performed.

On the other hand, if it is determined that the leading edge of the succeeding sheet 1-B has reached the determination position P3 (YES in step S102), it is determined whether the trailing edge of the preceding sheet 1-A has passed through the conveyance nip portion (step S105). If it is determined that the trailing edge of the preceding sheet 1-A has passed through the conveyance nip portion (YES in step S105), the succeeding sheet does not overlap the preceding sheet. Thus, a skew correction operation for only the succeeding sheet 1-B is decided (step S106). That is, only the succeeding sheet 1-B is made to abut against the conveyance nip portion to perform a skew correction operation, and then alignment of only the succeeding sheet 1-B is performed.

On the other hand, if it is determined that the trailing edge of the preceding sheet 1-A has not passed through the conveyance nip portion (NO in step S105), it is determined whether the overlap amount of the trailing edge of the preceding sheet 1-A and the leading edge of the succeeding sheet 1-B is smaller than a threshold (step S107). The position of the trailing edge of the preceding sheet 1-A is updated along with the printing operation of the preceding sheet 1-A. The position of the leading edge of the succeeding sheet 1-B is at the above-described determination position. That is, the overlap amount decreases along with the printing operation of the preceding sheet 1-A. If it is determined that the overlap amount is smaller than the threshold (YES in step S107), the overlap state is canceled, and a skew correction operation for only the succeeding sheet 1-B is decided (step S108). That is, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A. However, the feeding roller 3 is not driven. Therefore, the overlap state is canceled. Furthermore, only the succeeding sheet 1-B is made to abut against the conveyance nip portion to perform a skew correction operation, and then alignment of only the succeeding sheet 1-B is performed.

If it is determined that the overlap amount is equal to or larger than the threshold (NO in step S107), it is determined whether there is a gap between the last row of the preceding sheet and the row immediately preceding the last row (step S109). If it is determined that there is no gap (NO in step S109), the overlap state is canceled and a skew correction operation for only the succeeding sheet 1-B is decided (step S110). The skew correction operation of the succeeding sheet 1-B may influence the image forming operation of the preceding sheet 1-A. If there is no gap, the influence may be conspicuous, and thus the overlap state is canceled to perform a skew correction operation for only the succeeding sheet 1-B.

If it is determined that there is a gap (YES in step S109), the skew correction operation of the succeeding sheet 1-B is performed while keeping the overlap state (step S111), and then alignment of the succeeding sheet 1-B is performed. That is, after the start of the image forming operation of the last row of the preceding sheet 1-A, the succeeding sheet 1-B is made to abut against the conveyance nip portion while the succeeding sheet 1-B overlaps the preceding sheet 1-A. Upon end of the image forming operation of the last row, the conveyance roller 5 and the feeding roller 3 are rotated by driving the feeding motor 206 together with the conveyance motor 205, and alignment of the succeeding sheet 1-B is performed while it overlaps the preceding sheet 1-A. As described above, the operation of determining whether to keep or cancel the overlap state between the preceding sheet 1-A and the succeeding sheet 1-B is performed.

As described above, according to this embodiment, successive overlapped conveyance is executed by nipping and conveying the trailing edge of the preceding sheet 1-A and the leading edge of the succeeding sheet 1-B at least on condition that printing of the preceding sheet 1-A has ended (steps S17 and S18). In this case, during the printing operation of the preceding sheet 1-A, only the preceding sheet 1-A is nipped and conveyed by the conveyance nip portion. Therefore, the conveyance accuracy never decreases or the printing quality never degrades. Since successive overlapped conveyance is executed after the end of printing of the preceding sheet 1-A, the printing speed can be increased.

According to the above embodiment, at the start of feeding of the succeeding sheet 1-B, it is not necessary to confirm whether to execute successive overlapped conveyance. This is advantageous in that even if the marginal amount of the succeeding sheet 1-B is uncertain at the start of feeding of the succeeding sheet 1-B, it is possible to execute successive overlapped conveyance when the marginal amount is confirmed.

Furthermore, according to the above embodiment, the synchronous and asynchronous operations of the feeding motor 206 and the conveyance motor 205 are switched when performing the printing operation of the preceding sheet 1-A by the printhead 7. More specifically, before the sheet detection sensor 16 detects the leading edge of the succeeding sheet 1-B, the feeding motor 206 is driven in synchronism with the conveyance motor 205. On the other hand, after the sheet detection sensor 16 detects the leading edge of the succeeding sheet, the feeding motor 206 is continuously driven. Continuously driving the feeding motor makes it possible to perform a chasing operation to make the succeeding sheet 1-B overlap the preceding sheet 1-A, and to adjust the overlap amount of the preceding and succeeding printing sheets 1 in successive overlapped conveyance. The overlap amount is set by referring to the printing data of the preceding sheet 1-A and that of the succeeding sheet 1-B.

Note that in the above embodiment, the preceding sheet 1-A and the succeeding sheet 1-B are fed while having an interval there between. An arrangement of conveying the sheets while they overlap each other at the time of feeding can be adopted.

Second Embodiment

The second embodiment of the present invention will be described below. Note that an arrangement is the same as in the first embodiment, unless otherwise specified. The first embodiment has exemplifies a case in which only the preceding sheet 1-A is nipped and conveyed by the conveyance nip portion during the printing operation of the preceding sheet 1-A. In this embodiment, a case in which only a succeeding sheet 1-B is nipped and conveyed by a conveyance nip portion during the printing operation of the succeeding sheet 1-B will be explained.

Figure 10:
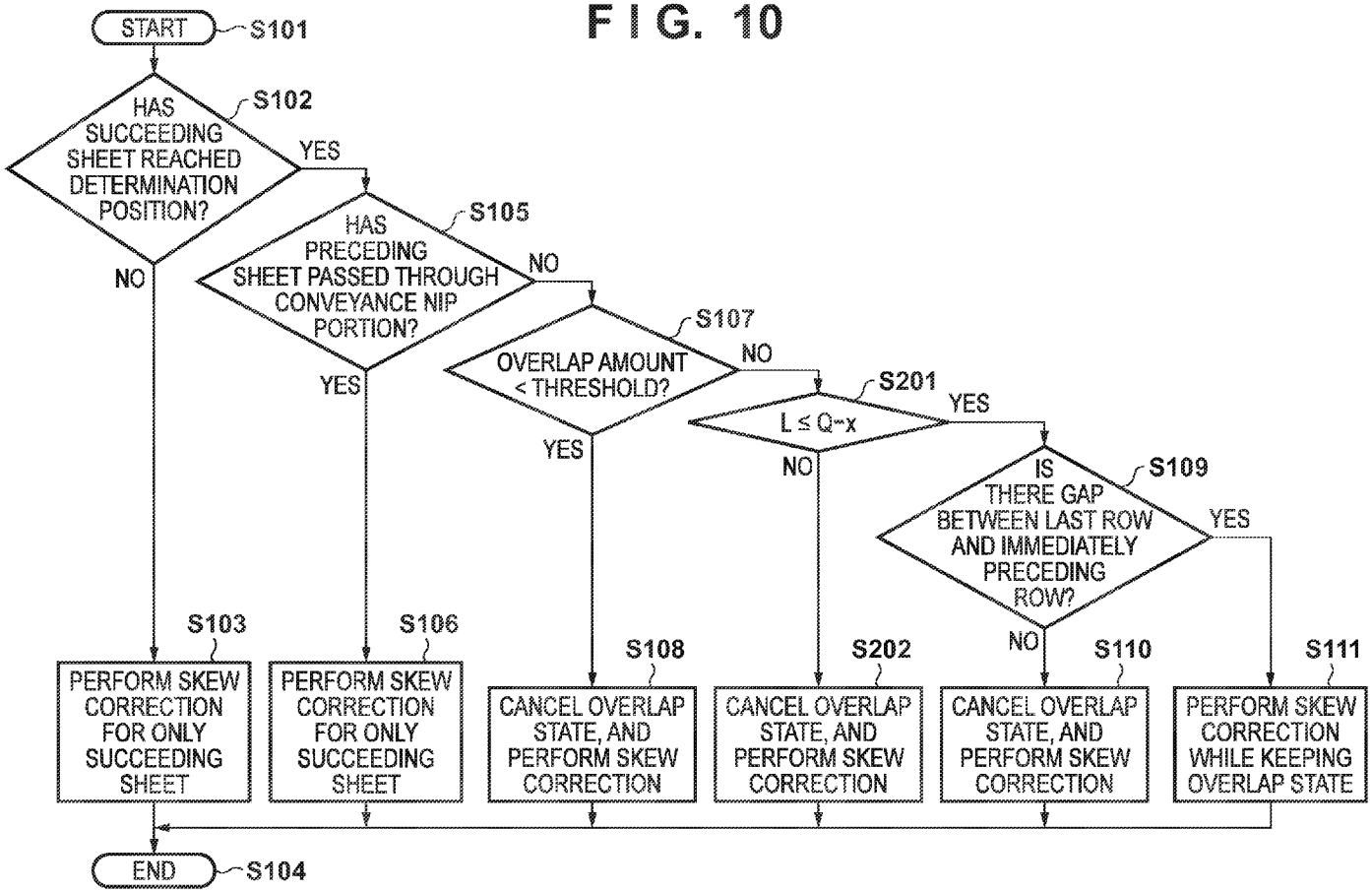
FIG. 10 is a flowchart illustrating an example of another processing.

FIG. 10 is a flowchart for explaining the skew correction operation of the succeeding sheet according to this embodiment. This processing is an alternative to the processing example shown in FIG. 9. The same reference symbols as those in FIG. 9 denote the same processes in FIG. 10 and a description thereof will be omitted. Different processes will be explained below.

In this embodiment, if it is determined in step S107 that an overlap amount is equal to or larger than a threshold, processing in step S201 is executed. If YES is determined in the processing in step S201, the process advances to step S109; otherwise, the process advances to step S202.

In step S201, it is determined whether the trailing edge of a preceding sheet 1-A has passed through the conveyance nip portion when successive overlapped conveyance is executed to perform alignment of the succeeding sheet 1-B. A determination method will be described with reference to FIG. 11.

Figure 11:
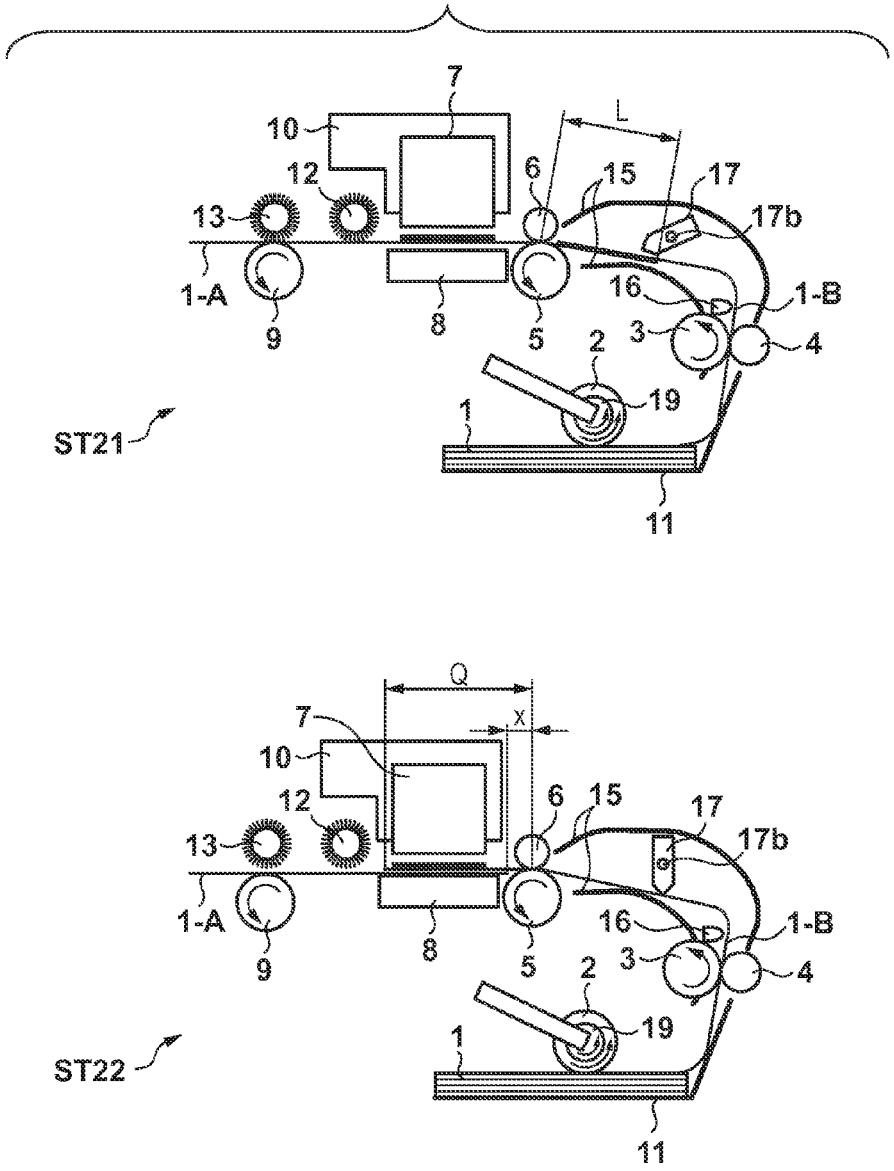
FIG. 11 is a view for explaining the operation of the printing apparatus shown in FIG. 1.

In a state ST21 of FIG. 11, printing of the preceding sheet 1-A ends (the image forming operation of the last row is performed). In this state, L represents a length from the conveyance nip portion to the trailing edge of the preceding sheet 1-A. If, in this state, the skew correction operation of the succeeding sheet 1-B is performed and successive overlapped conveyance is performed by making the succeeding sheet 1-B overlap the preceding sheet 1-A, the overlap amount of the sheets is equal to the length L of the preceding sheet 1-A.

In a state ST22 of FIG. 11, alignment of the succeeding sheet 1-B is performed. In this state, Q represents a length from the conveyance nip portion to the leading edge of the succeeding sheet 1-B. If, in this state, the trailing edge of the preceding sheet 1-A has passed through the conveyance nip portion, only the succeeding sheet 1-B is nipped and conveyed by the conveyance nip portion during the printing operation of the succeeding sheet 1-B. To cope with this, for example, a distance x (>0) between the conveyance nip portion and the trailing edge of the preceding sheet 1-A is set. If the distance x is 0, the trailing edge of the preceding sheet 1-A may have not surely passed through the conveyance nip portion due to a detection error of a sheet detection sensor 16 or a conveyance error of a conveyance roller 5. The overlap amount of the preceding sheet 1-A and the succeeding sheet 1-B is expressed by Q-x.

These values are used. Only if $L \leq Q-x$ is satisfied, the preceding sheet 1-A has passed through the conveyance nip portion at the time of alignment of the succeeding sheet 1-B. It is determined in step S201 whether this condition is satisfied. Note that methods of calculating the values L and Q will be described later.

If it is determined that the trailing edge of the preceding sheet 1-A has not passed through the conveyance nip portion, the process advances to step S202 to cancel the overlap state and decide a skew correction operation for only the succeeding sheet 1-B. That is, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A. However, the feeding roller 3 is not driven. Therefore, the overlap state is canceled. Furthermore, only the succeeding sheet 1-B is made to abut against the conveyance nip portion to perform a skew correction operation, and then alignment of only the succeeding sheet 1-B is performed.

If it is determined that the trailing edge of the preceding sheet 1-A has passed through the conveyance nip portion when alignment of the succeeding sheet 1-B is performed (YES in step S202), the process advances to step S111. The following processing is the same as in the first embodiment.

Figure 12:
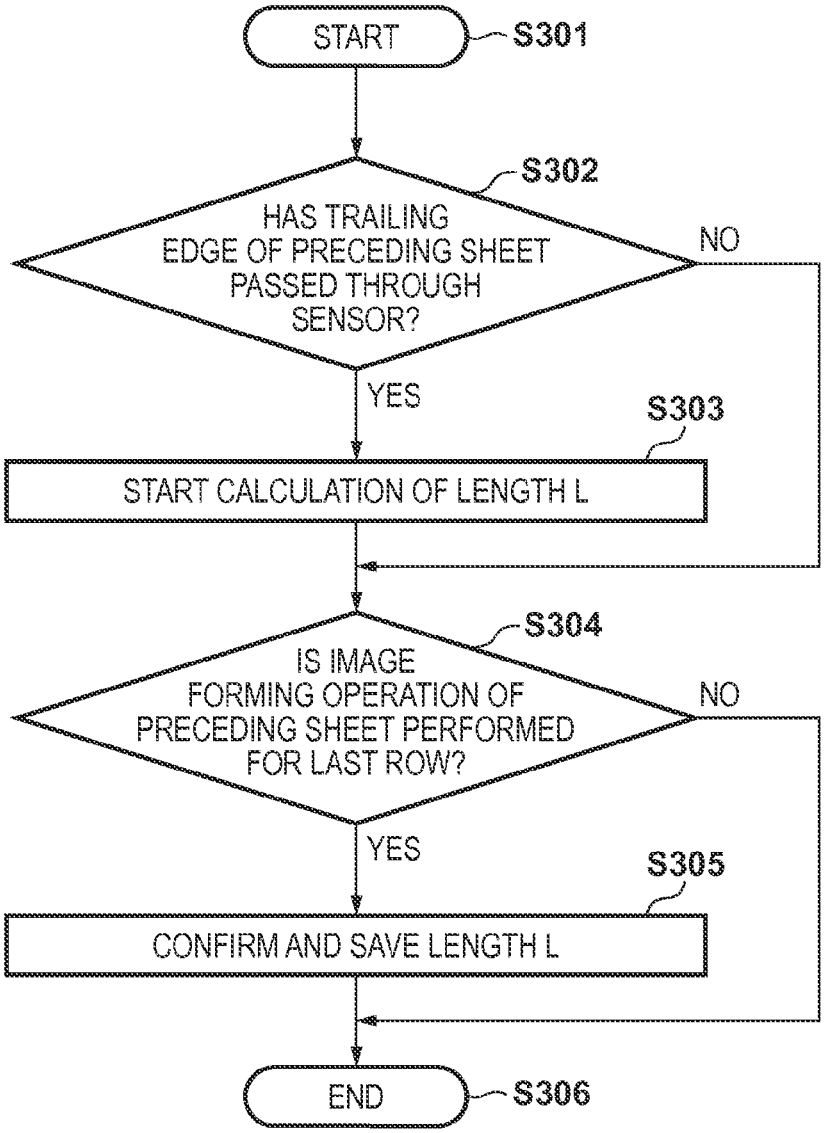
FIG. 12 is a flowchart illustrating an example of still another processing.

An example of processing of calculating the length L will be described with reference to FIG. 12. In step S301, the process starts. In step S302, based on the detection result of the sensor 16, it is determined whether the trailing edge of the preceding sheet 1-A has passed through the sensor 16. If it is determined that the trailing edge of the preceding sheet 1-A has passed through the sensor 16, the process advances to step S303; otherwise, the process advances to step S304.

Figure 5:
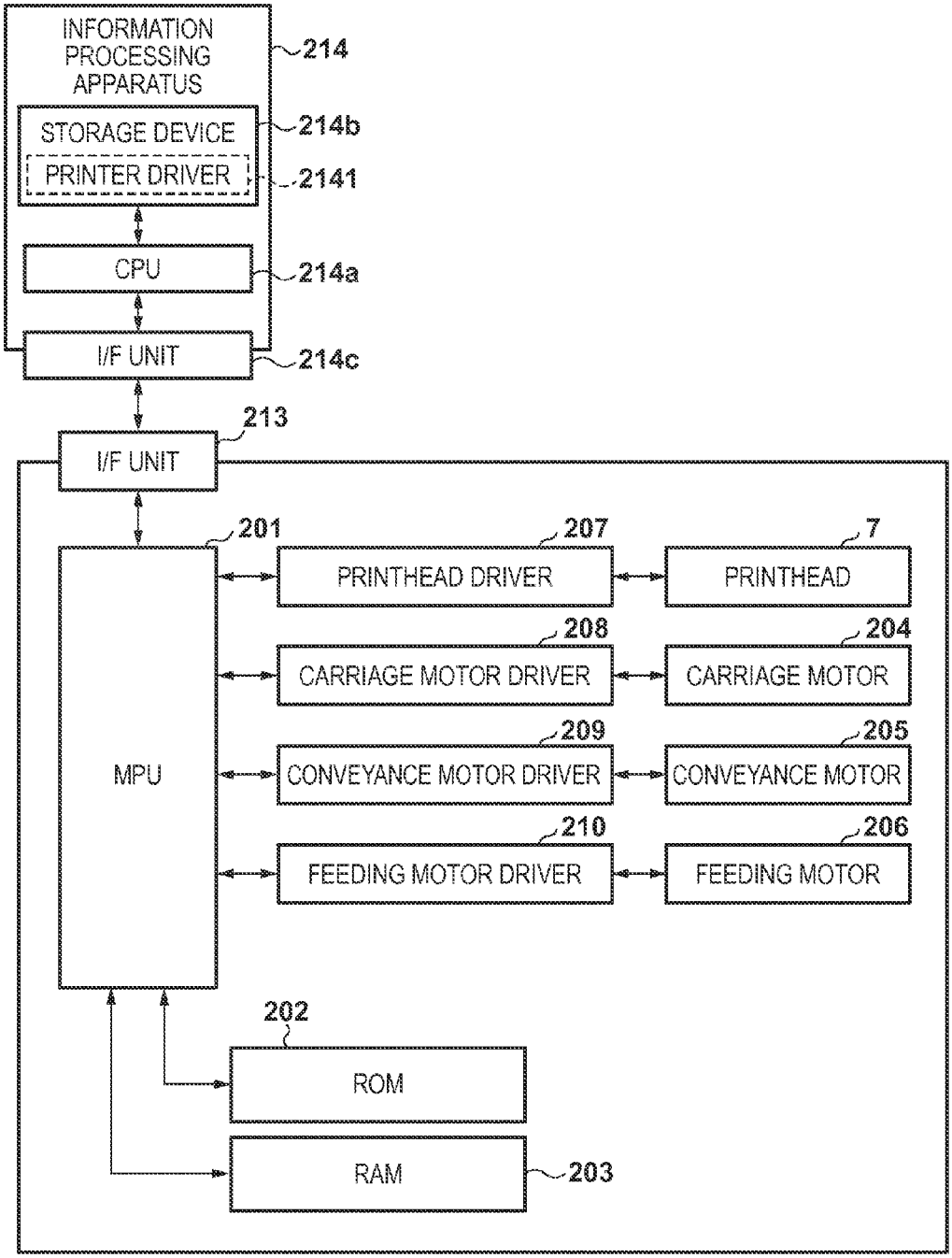
FIG. 5 is a block diagram showing an example of the arrangement of a printing system according to the embodiment of the present invention.

In step S303, calculation of the length L shown in FIG. 5 starts. The length L is calculated by, for example, L=predetermined value M−conveyance amount N. The predetermined value M represents the distance between the sensor 16 and the conveyance nip portion, and can be stored in a ROM 202. The conveyance amount N is the conveyance amount (variable) of the preceding sheet 1-A by the conveyance roller 5 after the trailing edge of the preceding sheet 1-A passes through the sensor 16.

In step S304, it is determined whether the image forming operation of the preceding sheet 1-A is performed for the last row. If the image forming operation of the preceding sheet 1-A is not performed for the last row (NO in step S304), the processing of calculating the length L which has started in step S303 described above continues. As the conveyance amount N increases, the length L decreases. If the image forming operation of the preceding sheet 1-A is performed for the last row (YES in step S304), the process advances to step S305.

In step S305, calculation of the length L ends, and the current value of the length L is set as a confirmed value. The confirmed value of the length L is saved in, for example, a RAM 203. After that, the processing of one unit ends (step S306).

Figure 13:
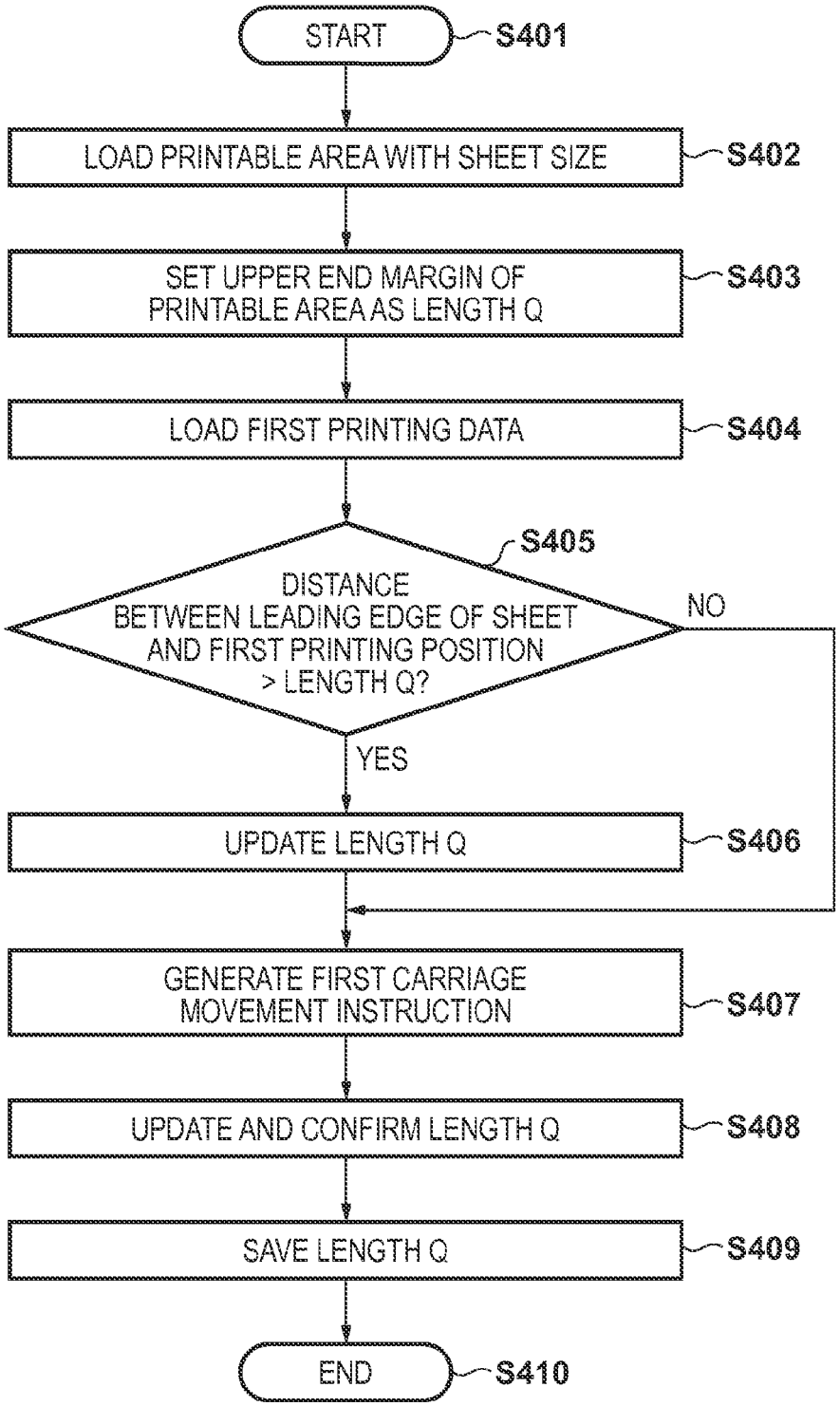
FIG. 13 is a flowchart illustrating an example of still another processing.

An example of processing of calculating the length Q will be described with reference to FIG. 13. In step S401, the process starts. In step S402, information about a printable area corresponding to the sheet size of the succeeding printing sheet 1-B is loaded. The printable area information can be stored in, for example, the ROM 202. Based on the printable area information, the uppermost printable position, that is, the upper end margin is specified. The upper end margin is temporarily set as the length Q (step S403).

The first printing data to be printed on the succeeding printing sheet 1-B is loaded (step S404). The first printing data indicates that requiring an ink discharge operation. That is, the printing data includes no blank. With this processing, the position of the first printing data from the leading edge of the sheet is specified. In other words, a non-printing area is specified. It is determined whether the distance between the leading edge of the succeeding printing sheet 1-B and the first printing data is larger than the previously, temporarily set length Q (step S405). If the distance is larger than the length Q, the process advances to step S406; otherwise, the process advances to step S407. In step S406, the length Q is updated by the distance between the leading edge of the succeeding printing sheet 1-B and the first printing data.

Next, the first carriage movement instruction is generated (step S407). Generating a carriage movement instruction decides a nozzle to be used to print the first printing data. In step S408, the length Q is updated, as needed, and is confirmed so that the position of the decided nozzle coincides with the printing start position of the succeeding printing sheet 1-B. The confirmed value of the length Q is saved in, for example, the RAM 203 (step S409), thereby terminating the process (step S410).

Note that the step of calculating the leading edge position after alignment of the succeeding sheet corresponds to step S9 of the flowchart illustrating the successive overlapped conveyance operation shown in FIG. 6A, and can start immediately after it is confirmed that there is the printing data of the next page.

The determination processing in step S109 of FIG. 9 is performed using the obtained length Q. Therefore, calculation of the length Q is ended before step S102 of the flowchart shown in FIG. 9, that is, before the succeeding sheet 1-B reaches the determination position.

As described above, according to this embodiment, the lengths L and Q are calculated based on the printing data of the preceding sheet and succeeding sheet. The length L indicates the position of the trailing edge of the preceding sheet 1-A at the time of the image forming operation of the last row of the preceding sheet 1-A. The length Q indicates the position of the leading edge of the succeeding sheet 1-B at the time of alignment of the succeeding sheet 1-B.

The preceding sheet 1-A and succeeding sheet 1-B are controlled to be conveyed to the printhead 7 while they overlap each other based on the calculation results so that the trailing edge of the preceding sheet 1-A has passed through the conveyance nip portion at the time of alignment of the succeeding sheet 1-B.

This prevents the conveyance nip portion from nipping the preceding sheet 1-A and the succeeding sheet 1-B while they overlap each other at the time of the printing operation of the succeeding sheet 1-B. As a result, the conveyance accuracy of the preceding sheet 1-A and succeeding sheet 1-B never decreases or the printing quality never degrades. Since successive overlapped conveyance is executed after the end of printing of the preceding sheet 1-A, the printing speed can be increased.

Note that in the first and second embodiments, the arrangement in which successive overlapped conveyance is performed by making the succeeding sheet 1-B overlap the preceding sheet 1-A on the side of the printhead 7 is adopted. As described in the first embodiment, it is possible to prevent the succeeding sheet 1-B from entering between the preceding sheet 1-A and the printhead 7 at the time of the printing operation of the preceding sheet 1-A by starting successive overlapped conveyance after the end of printing of the preceding sheet 1-A.

If the printing speed is prioritized, only the control operation according to the first embodiment may be performed. Conversely, as described in the second embodiment, during the printing operation of the succeeding sheet 1-B, the conveyance nip portion may be controlled to nip and convey only the succeeding sheet 1-B. That is, it is possible to execute successive overlapped conveyance at least on condition that the conveyance nip portion does not nip and convey the overlapping portion between the preceding sheet 1-A and the succeeding sheet 1-B during at least one of the printing operation of the preceding sheet 1-A or the printing operation of the succeeding sheet 1-B.

Third Embodiment

In the above-described first and second embodiments, a case in which the printing sheet 1 is made to abut against the conveyance nip portion to perform a skew correction operation has been explained. In this embodiment, a case in which no skew correction operation is performed will be described. Note that it is possible to manage the conveyance position of a printing sheet 1 based on a detection result of a sheet detection sensor 16 and a conveyance amount from the detection result as the starting point.

Figure 14:
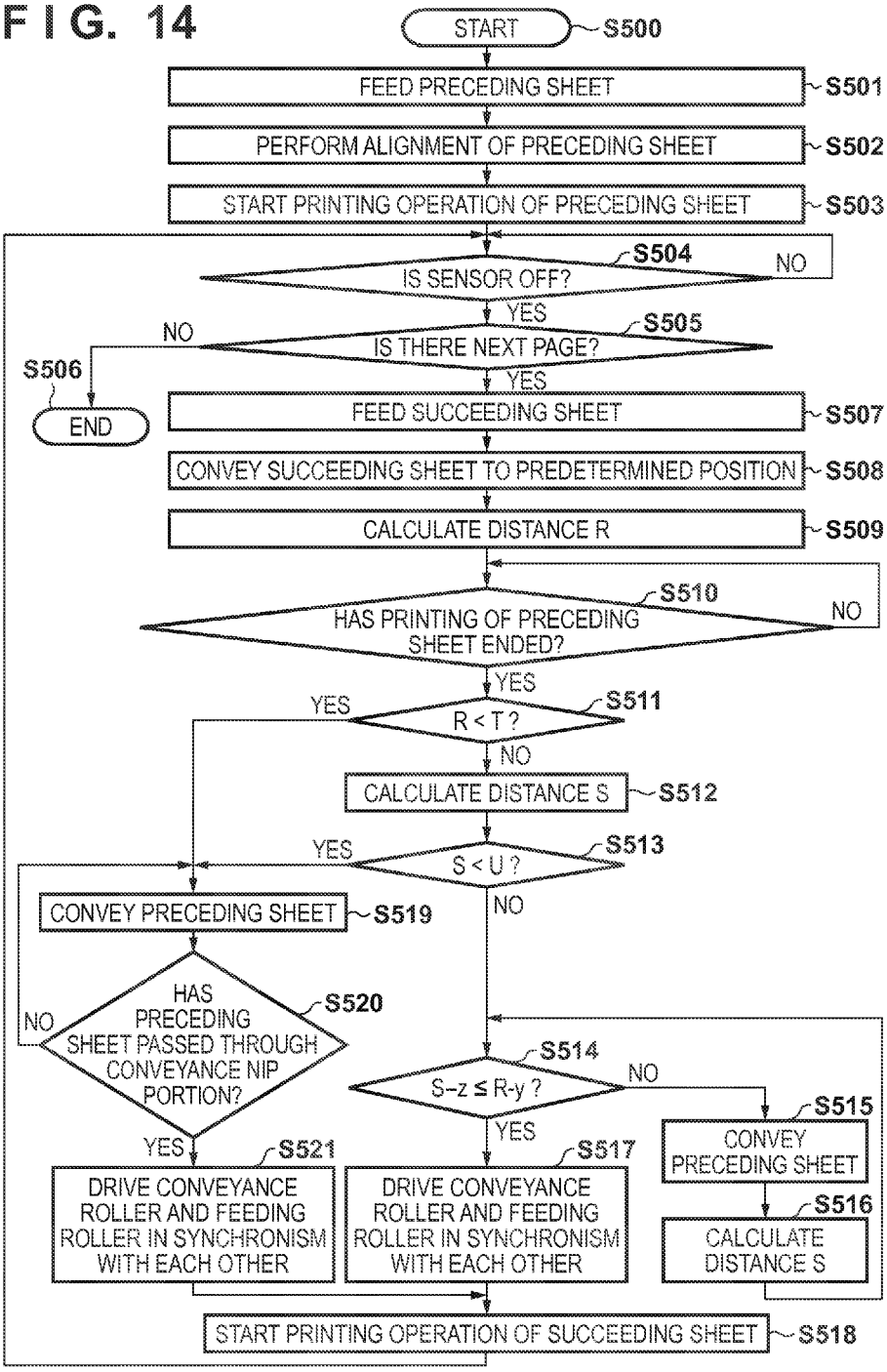
FIG. 14 is a flowchart illustrating an example of still another processing.

FIG. 14 is a flowchart illustrating a successive overlapped conveyance control operation according to this embodiment. FIGS. 15A to 15D are schematic views corresponding to the flowchart. Step S500 indicates the timing at which printing data is received from an information processing apparatus 214 via an I/F unit 213.

Upon receiving the printing data, a preceding sheet 1-A is fed (step S501), alignment is performed (step S502), and then a printing operation starts (step S503). In step S504, it is determined whether the trailing edge of the preceding sheet 1-A has passed through the sheet detection sensor 16. If the trailing edge has not passed through the sheet detection sensor 16, the processing in step S504 is repeated until the trailing edge passes through the sheet detection sensor 16.

If the trailing edge of the preceding sheet 1-A has passed through the sheet detection sensor 16, it is determined in step S505 whether there is the next page. If there is no next page, the printing operation continues. If the printing operation ends, the preceding sheet 1-A is conveyed to a discharge roller 9 to perform discharge processing, thereby terminating the processing of one unit (step S506). If there is the next page, control operations associated with successive overlapped conveyance in step S507 and subsequent steps are performed.

In step S507, a succeeding sheet 1-B is fed. In step S508, the succeeding sheet 1-B is conveyed until its leading edge is set at a position a predetermined distance y away from a conveyance nip portion, and the process stands by. This corresponds to the state shown in FIG. 15A. The predetermined distance y serves as a margin to reliably avoid the succeeding sheet 1-B from entering the conveyance nip portion.

Figure 15A:
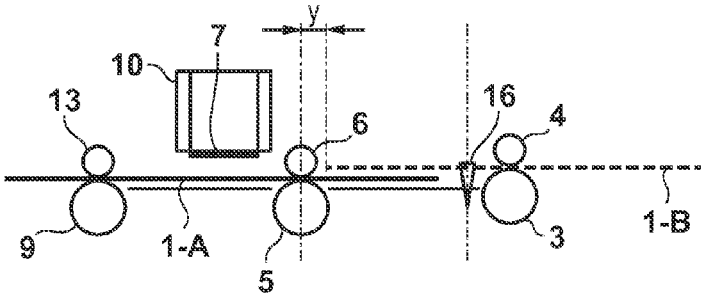
FIGS. 15A to 15D are views for explaining the operation of another printing apparatus.
Figure 15B:
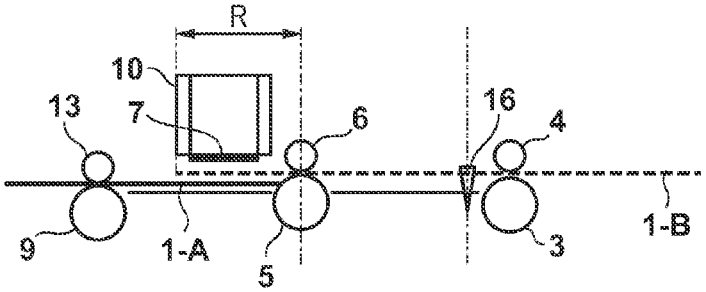

In step S509, a distance R is calculated based on the printing data of the succeeding sheet 1-B. The distance R is the distance between the conveyance nip portion and the leading edge of the succeeding sheet 1-B at the time of alignment of the succeeding sheet 1-B. FIG. 15B exemplifies the distance R. Note that steps S507 to S509 are sequentially performed for the sake of convenience in this example. However, when it is determined in step S505 that there is the next page, the processing in step S509 may be performed in parallel to the other processes in steps S507 and S508.

Figure 15C:
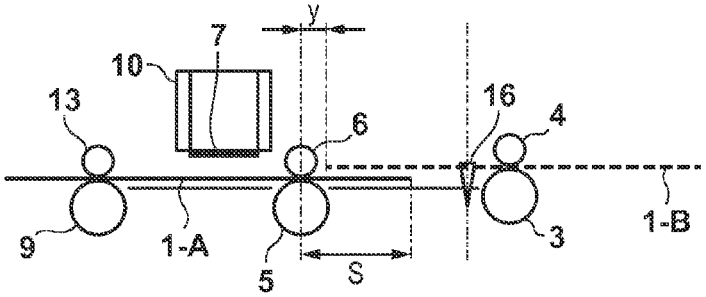
Figure 15D:
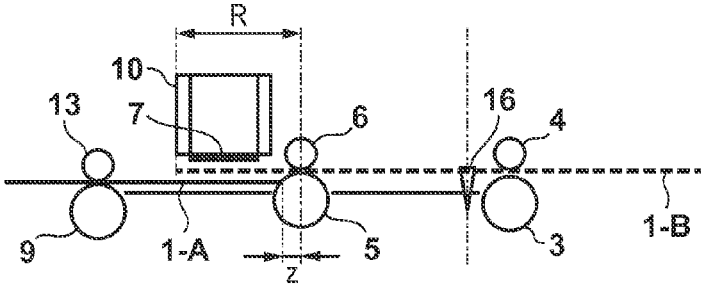

In this embodiment, it is required that the trailing edge of the preceding sheet 1-A has passed through the conveyance nip portion at the time of alignment of the succeeding sheet 1-B. This is because if the trailing edge has not passed the conveyance nip portion, the preceding sheet 1-A and the succeeding sheet 1-B overlap each other at the conveyance nip portion and thus the conveyance accuracy may decrease. As shown in FIG. 15D, the trailing edge of the preceding sheet 1-A is calculated as a position a predetermined distance z away from the conveyance nip portion. The predetermined distance z serves as a margin to make the preceding sheet 1-A reliably pass through the conveyance nip portion. As is apparent from FIG. 15D, the overlap amount of the preceding sheet 1-A and succeeding sheet 1-B at the time of alignment of the succeeding sheet 1-B is calculated by R-z.

In step S510, it is determined whether the printing operation of the preceding sheet 1-A has ended. This is a step of determining whether the leading edge of the succeeding sheet 1-B enters the conveyance nip portion before the end of the printing operation of the preceding sheet 1-A. If the printing operation has not ended, the processing in step S510 is repeated until the printing operation ends.

If the printing operation of the preceding sheet 1-A has ended, the above-described distance R of the leading edge at the time of alignment of the succeeding sheet 1-B is compared with a predetermined amount T in step S511.

If the distance R is smaller than the predetermined amount T, the process advances to step S519 to control not to make the succeeding sheet 1-B overlap the preceding sheet 1-A. This avoids a malfunction which may occur when the distance R, that is, the overlap amount R-z is small. As an example of the malfunction, the sheets do not overlap each other due to a conveyance error. As another example, since the overlap amount is small, the influence of the warp or deformation of the printing sheet 1 becomes large, thereby causing a failure in nipping by the conveyance nip portion.

In step S519, a conveyance roller 5 is driven to convey only the preceding sheet 1-A. In step S520, it is determined whether the trailing edge of the preceding sheet 1-A has passed through the conveyance nip portion, and conveyance of only the preceding sheet 1-A by the conveyance roller 5 is repeated until the trailing edge of the preceding sheet 1-A passes through the conveyance nip portion. If the trailing edge of the preceding sheet 1-A has passed through the conveyance nip portion, the process advances to step S521 to drive a feeding roller 3 and the conveyance roller 5 in synchronism with each other. This conveys the succeeding sheet 1-B to the printhead 7 and conveys the preceding sheet 1-A to the discharge roller 9. In step S518, the printing operation of the succeeding sheet 1-B starts. Processes in step S518 and subsequent steps are the same as those for the preceding sheet 1-A and a detailed description thereof will be provided later.

If it is determined in step S511 that the distance R is larger than the predetermined amount T, the process advances to step S512. In this example, a distance S between the conveyance nip portion and the trailing edge of the preceding sheet 1-A is calculated. FIG. 15C exemplifies the distance S. The overlap amount of the preceding sheet 1-A and succeeding sheet 1-B at the end of the printing operation of the preceding sheet 1-A is calculated by S-y.

In step S513, the distance S is compared with a predetermined amount U. If the distance S is smaller than the predetermined amount U, the process advances to step S519 to control not to make the succeeding sheet 1-B overlap the preceding sheet 1-A. This avoids a malfunction which may occur when the distance S, that is, the overlap amount S-y is small, similarly to the above-described distance R. An operation when the sheets are not made to overlap each other is the same as the above-described one and a description thereof will be omitted.

If the distance S is larger than the predetermined amount U, the process advances to step S514 to compare overlap amounts R−y and S−z. If the overlap amount R−y is larger than the overlap amount S−z, when the succeeding sheet 1-B is conveyed, the trailing edge of the preceding sheet 1-A is kept nipped by the conveyance nip portion at the time of alignment of the succeeding sheet 1-B. To avoid this, if the overlap amount R−y is larger than the overlap amount S−z, the process advances to step S515 to convey only the preceding sheet 1-A without conveying the succeeding sheet 1-B. In step S516, the conveyance amount of the preceding sheet 1-A in step S515 is subtracted from the distance S, thereby updating the distance S. The process then returns to step S514 to repeat the step of conveying only the preceding sheet 1-A without conveying the succeeding sheet 1-B until the overlap amount S−z becomes smaller than the overlap amount R−y. When the overlap amount S−z becomes smaller than the overlap amount R−y, the process advances to step S517.

In step S517, the preceding sheet 1-A and succeeding sheet 1-B are conveyed to the printhead 7 while they overlap each other. In step S518, the printing operation of the succeeding sheet 1-B starts. As described above, at the start of the printing operation of the succeeding sheet 1-B, the state is that shown in FIG. 15D, that is, the trailing edge of the preceding sheet 1-A has passed through the conveyance nip portion. Therefore, the printing accuracy of the succeeding sheet 1-B is never influenced. The process returns to step S504 to repeat the same steps until it is determined that there is no next page.

In this embodiment, as described above, the distance S associated with the position of the preceding sheet 1-A and the distance R associated with the position of the succeeding sheet 1-B at the time of alignment of the succeeding sheet 1-B are calculated based on the printing data of the printing sheet 1.

When the two printing sheets 1 are conveyed while they overlap each other in successive overlapped conveyance, it is controlled so that the succeeding sheet 1-B does not enter the conveyance nip portion at the time of printing of the last row of the preceding sheet 1-A. Also, it is controlled so that the trailing edge of the preceding sheet 1-A has passed through the conveyance nip portion at the time of the printing operation of the succeeding sheet 1-B.

This prevents printing on the preceding sheet 1-A or succeeding sheet 1-B while the two printing sheets overlap each other at the conveyance nip portion. Therefore, the conveyance accuracy of the preceding sheet 1-A and succeeding sheet 1-B never decreases or the printing quality never degrades. Since successive overlapped conveyance is executed after the end of printing of the preceding sheet 1-A, the printing speed can be increased.

When executing successive overlapped conveyance, if it is first determined that the condition is not satisfied, only the preceding sheet 1-A is conveyed. Then, as soon as the condition is satisfied, the preceding sheet 1-A and succeeding sheet 1-B are conveyed in synchronism with each other (steps S515 and S516). This makes it possible to convey the succeeding sheet 1-B to the printhead 7 not only while the preceding sheet 1-A stops, that is, the conveyance roller 5 stops, but also during conveyance of the preceding sheet 1-A. It is possible to further decrease the interval between the preceding sheet 1-A and the succeeding sheet 1-B, thereby increasing the printing speed.

Fourth Embodiment

In the first to third embodiments, it is assumed that the sheets are made to overlap each other in successive overlapped conveyance so that the succeeding sheet 1-B is at a position on the side of the printhead 7 with respect to the preceding sheet 1-A. However, the positional relationship may be reversed. That is, the sheets may be made to overlap each other so that the preceding sheet 1-A is at a position on the side of the printhead 7 with respect to the succeeding sheet 1-B. Such overlap state can be implemented by, for example, providing a lever for pushing the trailing edge of the preceding sheet 1-A upward as a lever corresponding to the sheet pressing lever 17.

An example of conveyance control when a preceding sheet 1-A is at a position on the side of the printhead 7 will be described below. A case in which no skew correction operation is performed as described in the third embodiment will be explained. This embodiment, however, is also applicable to a case in which a skew correction operation is performed.

Figure 16:
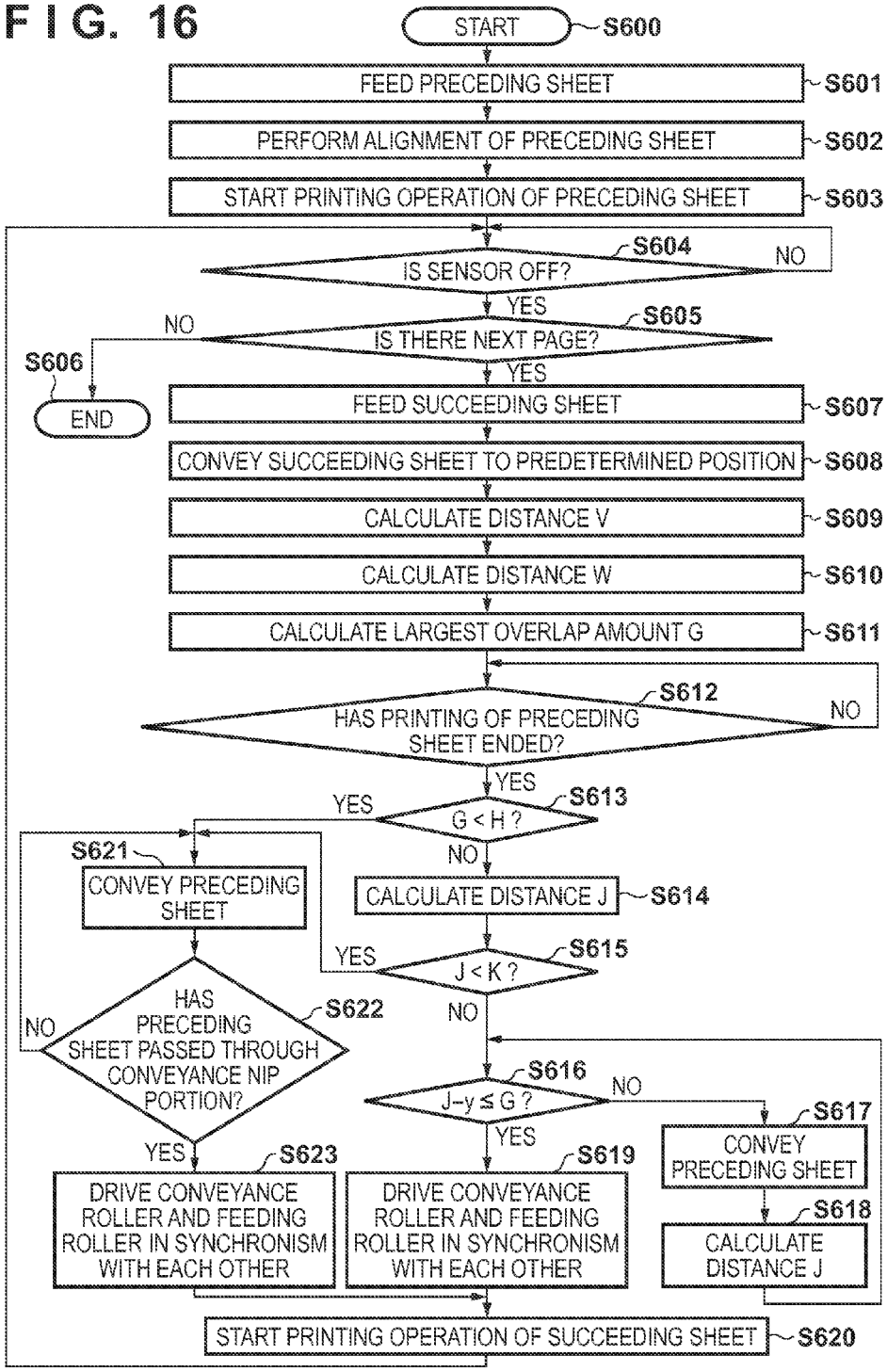
FIG. 16 is a flowchart illustrating an example of still another processing.
Figure 17A:
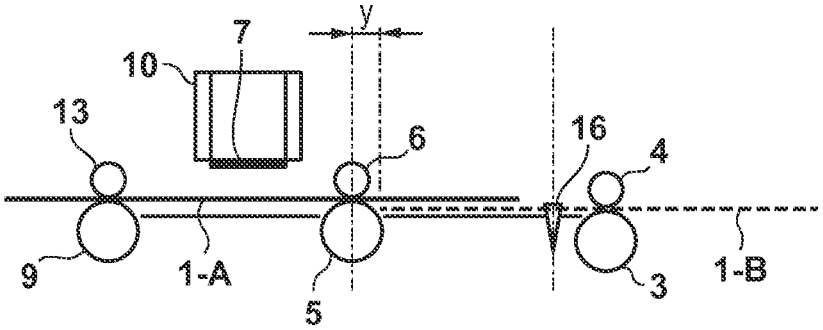
FIGS. 17A to 17C are views for explaining the operation of still another printing apparatus.
Figure 17B:
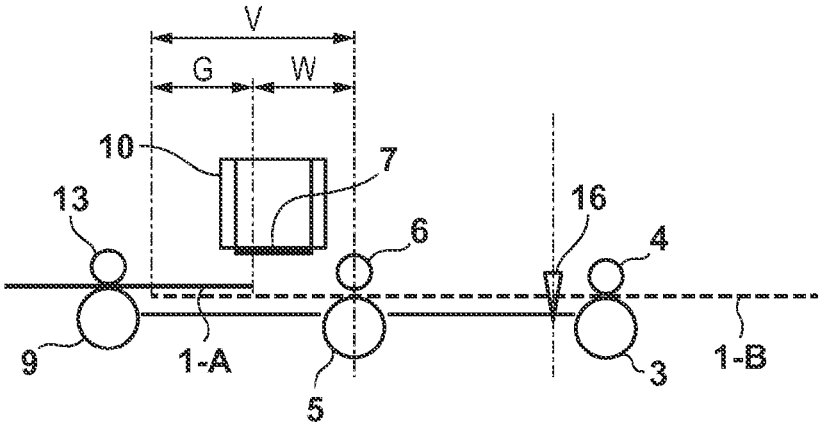
Figure 17C:
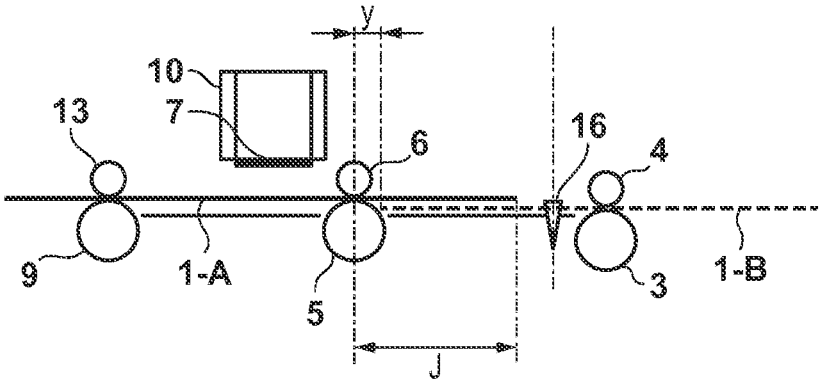

FIG. 16 is a flowchart illustrating successive overlapped conveyance control according to this embodiment. FIGS. 17A to 17C are schematic views corresponding to the flowchart. Step S600 indicates the timing at which printing data is received from an information processing apparatus 214 via an I/F unit 213. Processes in steps S601 to S608 are the same as those in steps S501 to S508 in the third embodiment and a description thereof will be omitted. Note that the succeeding sheet 1-B is conveyed in step S608 until its leading edge is set at a position a predetermined distance y away from the conveyance nip portion, as shown in FIG. 17A, and the process stands by, similarly to step S508. Processes in step S609 and subsequent steps will be described below.

In steps S609 and S610, distances V and W are calculated based on the printing data. In step S609, the distance V between a conveyance nip portion and the leading edge of the succeeding sheet 1-B at the time of alignment of the succeeding sheet 1-B is calculated. In step S610, the distance W between the conveyance nip portion and the trailing edge of the preceding sheet 1-A at the time of alignment of the succeeding sheet 1-B is calculated. At the time of alignment of the succeeding sheet 1-B, the trailing edge of the preceding sheet 1-A needs to have passed through not only the conveyance nip portion but also the printhead 7. That is, the preceding sheet 1-A needs to be at a position which has no influence on the printing operation of the succeeding sheet 1-B. In step S611, based on the two distances V and W, a largest overlap amount G of the two printing sheets at the time of alignment of the succeeding sheet 1-B is calculated. As shown in FIG. 17B, the largest overlap amount G is represented by V−W.

In step S612, it is determined whether the printing operation of the preceding sheet 1-A has ended. This is a step of determining whether the leading edge of the succeeding sheet 1-B enters the conveyance nip portion before the end of the printing operation of the preceding sheet 1-A. If the printing operation has not ended, the processing in step S612 is repeated until the printing operation ends.

If the printing operation of the preceding sheet 1-A has ended, the above-described largest overlap amount G of the preceding sheet 1-A and succeeding sheet 1-B at the time of alignment of the succeeding sheet 1-B is compared with a predetermined amount H in step S613.

If the largest overlap amount G is smaller than the predetermined amount H, the process advances to step S621 to control not to make the succeeding sheet 1-B overlap the preceding sheet 1-A. This avoids a malfunction which may occur when the largest overlap amount G is small. As an example of the malfunction, the sheets do not overlap each other due to a conveyance error. As another example, since the overlap amount is small, the influence of the warp or deformation of the printing sheet 1 becomes large, thereby causing a failure in nipping by the conveyance nip portion.

In step S621, a conveyance roller 5 is driven to convey only the preceding sheet 1-A. In step S622, it is determined whether the trailing edge of the preceding sheet 1-A has passed through the conveyance nip portion, and conveyance of only the preceding sheet 1-A by the pair of conveyance rollers is repeated until the trailing edge of the preceding sheet 1-A passes through the conveyance nip portion.

If the trailing edge of the preceding sheet 1-A has passed through the conveyance nip portion, the process advances to step S623 to drive a feeding roller 3 and the conveyance roller 5 in synchronism with each other. This conveys the succeeding sheet 1-B to the printhead 7 and conveys the preceding sheet 1-A to a discharge roller 9. In step S620, the printing operation of the succeeding sheet 1-B starts. Processes in step S620 and subsequent steps are the same as those for the preceding sheet 1-A and a detailed description thereof will be provided later.

If the largest overlap amount G is larger than the predetermined amount H, the process advances to step S614. In this example, a distance J between the conveyance nip portion and the trailing edge of the preceding sheet 1-A is calculated. FIG. 17C exemplifies the distance J. The overlap amount of the preceding sheet 1-A and succeeding sheet 1-B at the end of the printing operation of the preceding sheet 1-A is calculated by J-y.

In step S615, the distance J is compared with a predetermined amount K. If the distance J is smaller than the predetermined amount K, the process advances to step S621 to control not to make the succeeding sheet 1-B overlap the preceding sheet 1-A. This avoids a malfunction which may occur when the distance J, that is, the overlap amount J-y is small, similarly to the above-described largest overlap amount G. An operation when the sheets are not made to overlap each other is the same as the above-described one and a description thereof will be omitted.

If the distance J is larger than the predetermined amount K, the process advances to step S616 to compare the largest overlap amount G with the overlap amount J-y. If the largest overlap amount G is larger than the overlap amount J-y, when the succeeding sheet 1-B is conveyed, the trailing edge of the preceding sheet 1-A does not pass through the printhead 7 at the time of the image forming operation of the succeeding sheet 1-B. To avoid this, if the largest overlap amount G is larger than the overlap amount J-y, the process advances to step S617 to convey only the preceding sheet 1-A without conveying the succeeding sheet 1-B. In step S618, the conveyance amount of the preceding sheet 1-A in step S617 is subtracted from the distance J, thereby updating the distance J. The process then returns to step S616 to repeat the step of conveying only the preceding sheet 1-A without conveying the succeeding sheet 1-B until the overlap amount J-y becomes smaller than the largest overlap amount G. When the overlap amount J-y becomes smaller than the largest overlap amount G, the process advances to step S619.

In step S619, the preceding sheet 1-A and succeeding sheet 1-B are conveyed to the printhead 7 while they overlap each other. In step S620, the printing operation of the succeeding sheet 1-B starts. As described above, when the printing operation of the succeeding sheet 1-B is performed, the state is that shown in FIG. 17B, that is, the trailing edge of the preceding sheet 1-A has passed through the printhead 7. Therefore, the image forming operation of the succeeding sheet 1-B is never influenced. The process returns to step S604 to repeat the same steps until it is determined that there is no next page.

As described above, even if the preceding sheet 1-A and the succeeding sheet 1-B are made to overlap each other so that the preceding sheet 1-A is at a position on the side of the printhead 7 with respect to the succeeding sheet 1-B, successive overlapped conveyance can be implemented.

As another example of the arrangement, a method of making the succeeding sheet 1-B overlap the preceding sheet 1-A (which of the preceding sheet 1-A and the succeeding sheet 1-B is at a position on the side of the printhead 7) may be selectable. In this case, calculated overlap amounts may be compared, thereby controlling to select a more appropriate method of making the sheets overlap each other.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2014-116205, filed Jun. 4, 2014, which is hereby incorporated by reference herein in its entirety.

What is claimed is:

1. A printing apparatus comprising:

a feeding roller configured to feed a printing sheet;

a conveyance roller configured to convey the printing sheet fed by said feeding roller;

a printing unit configured to print on the printing sheet conveyed by said conveyance roller;

a conveyance control unit configured to control conveyance of printing sheets so as to form an overlap state in which a trailing edge of a preceding sheet as a printing sheet precedingly fed by said feeding roller and a leading edge of a succeeding sheet as a printing sheet succeedingly fed by said feeding roller overlap each other; and a determination unit configured to determine whether to convey the succeeding sheet to a position facing said printing unit while keeping the overlap state or to convey the succeeding sheet to the position facing said printing unit after the overlap state has been cancelled, wherein if said determination unit determines to convey the succeeding sheet to the position facing said printing unit while keeping the overlap state, said conveyance control unit conveys the succeeding sheet to the position facing said printing unit after printing of the preceding sheet has ended.

2. The apparatus according to claim 1, wherein in the overlap state the succeeding sheet is at a position on a side of said printing unit with respect to the preceding sheet.

3. The apparatus according to claim 1, wherein if said determination unit determines to convey the succeeding sheet to the position facing said printing unit after the overlap state has been cancelled, said conveyance control unit conveys each of the preceding sheet and the succeeding sheet without making the preceding sheet and the succeeding sheet overlap each other.

4. A printing apparatus comprising:

a feeding roller configured to feed a printing sheet;

a conveyance roller configured to convey the printing sheet fed by said feeding roller;

a printing unit configured to print on the printing sheet conveyed by said conveyance roller;

a conveyance control unit configured to control conveyance of printing sheets so as to form an overlap state in which a trailing edge of a preceding sheet as a printing sheet precedingly fed by said feeding roller and a leading edge of a succeeding sheet as a printing sheet succeedingly fed by said feeding roller overlap each other; and a determination unit configured to determine whether or not the trailing edge of the preceding sheet has passed through said conveyance roller at a timing when the succeeding sheet is conveyed to a position facing said printing unit while keeping the overlap state, wherein if said determination unit determines that the trailing edge of the preceding sheet has not passed through said conveyance roller at the timing, said conveyance control unit conveys the succeeding sheet to the position facing said printing unit after the overlap state has been cancelled.

5. The apparatus according to claim 4, wherein based on printing data of the preceding sheet and printing data of the succeeding sheet, said determination unit determines whether or not the trailing edge of the preceding sheet has passed through said conveyance roller at the timing.

6. The apparatus according to claim 4, wherein said determination unit calculates, based on printing data of the preceding sheet, a first length from said conveyance roller to the trailing edge of the preceding sheet, the first length corresponding to when printing of the preceding sheet ends, calculates, based on printing data of the succeeding sheet, a second length from conveyance roller to the leading edge of the succeeding sheet, the second length corresponding to when the succeeding sheet is conveyed to the position facing said printing unit, and determines, based on the calculated first and second lengths, whether or not the trailing edge of the preceding sheet has passed through said conveyance roller at the timing.

7. The apparatus according to claim 4, wherein in the overlap state the succeeding sheet is at a position on a side of said printing unit with respect to the preceding sheet.

8. The apparatus according to claim 4, wherein if said determination unit determines that the trailing edge of the preceding sheet has not passed through said conveyance roller at the timing, said conveyance control unit cancels the overlap state by conveying the preceding sheet with the succeeding sheet standing by at a predetermined position.

9. A control method for a printing apparatus including a feeding roller configured to feed a printing sheet, a conveyance roller configured to convey the printing sheet fed by the feeding roller, and a printing unit configured to print on the printing sheet conveyed by the conveyance roller, the method comprising:

a conveyance control step of controlling conveyance of printing sheets so as to form an overlap state in which a trailing edge of a preceding sheet as a printing sheet precedingly fed by the feeding roller and a leading edge of a succeeding sheet as a printing sheet succeedingly fed by the feeding roller overlap each other; and a determination step of determining whether to convey the succeeding sheet to a position facing said printing unit while keeping the overlap state or to convey the succeeding sheet to the position facing said printing unit after the overlap state has been cancelled, wherein in the conveyance control step, if it is determined in the determination step to convey the succeeding sheet to the position facing said printing unit while keeping the overlap state, the succeeding sheet is conveyed to the position facing said printing unit after printing of the preceding sheet has ended.

10. A control method for a printing apparatus including a feeding roller configured to feed a printing sheet, a conveyance roller configured to convey the printing sheet fed by said feeding roller, and a printing unit configured to print on the printing sheet conveyed by said conveyance roller, the method comprising:

a conveyance control step of controlling conveyance of printing sheets so as to form an overlap state in which a trailing edge of a preceding sheet as a printing sheet precedingly fed by the feeding roller and a leading edge of a succeeding sheet as a printing sheet succeedingly fed by the feeding roller overlap each other; and a determination step of determining whether or not the trailing edge of the preceding sheet has passed through the conveyance roller at a timing when the succeeding sheet is conveyed to a position facing the printing unit while keeping the overlap state, wherein in the conveyance control step, if it is determined in the determination step that the trailing edge of the preceding sheet has not passed through said conveyance roller at the timing, the succeeding sheet is conveyed to the position after the overlap state has been canceled.

11. A printing apparatus comprising:

a feeding roller configured to feed a printing sheet;

a pair of conveyance rollers configured to nip and convey the printing sheet fed by said feeding roller;

a printing unit configured to perform a printing operation for printing on the printing sheet conveyed by said pair of conveyance rollers; and a conveyance control unit configured to control a conveyance of the printing sheet so that said pair of conveyance rollers nip and convey an overlapping portion where a trailing edge of a preceding sheet, which is a printing sheet precedingly fed by said feeding roller, and a leading edge of a succeeding sheet, which is a printing sheet succeedingly fed by said feeding roller, overlap each other, wherein said conveyance control unit controls the conveyance of the printing sheet so that said printing unit does not perform the printing operation for the preceding sheet or the succeeding sheet in a state that said pair of conveyance rollers nip the overlapping portion.

12. The apparatus according to claim 11, wherein said conveyance control unit prevents said pair of conveyance rollers from nipping the overlapping portion while said printing unit performs the printing operation.

13. The apparatus according to claim 12, wherein said conveyance control unit makes said pair of conveyance rollers nip the overlapping portion when said printing unit does not perform the printing operation.

14. The apparatus according to claim 11, wherein if said printing unit performs the printing operation for the preceding sheet, said conveyance control unit makes said pair of conveyance rollers nip and convey the succeeding sheet after the printing operation for the preceding sheet has been completed.

15. The apparatus according to claim 11, wherein if said printing unit performs the printing operation for the preceding sheet, said conveyance control unit makes said pair of conveyance rollers nip the overlapping portion after the printing operation for preceding sheet has been completed.

16. The apparatus according to claim 11, further comprising an estimating unit configured to estimate whether or not the trailing edge of the preceding sheet will pass through said pair of conveyance rollers when the succeeding sheet conveyed by said pair of conveyance rollers reaches a start position of the printing operation by said printing unit, wherein said conveyance control unit prevents said pair of conveyance rollers from nipping the overlapping portion when said estimating unit estimates that the trailing edge of the preceding sheet will not pass through said pair of conveyance rollers.

17. The apparatus according to claim 16, wherein when said estimating unit estimates that the trailing edge of the preceding sheet will not pass through said pair of conveyance rollers, said conveyance control unit makes said pair of conveyance rollers nip and convey the succeeding sheet to the start position after the trailing edge of the preceding sheet has passed through said pair of conveyance rollers.

18. The apparatus according to claim 16, wherein said estimating unit estimate whether or not the trailing edge of the preceding sheet will pass through said pair of conveyance rollers based on printing data of the preceding sheet and printing data of the succeeding sheet.

19. The apparatus according to claim 16, wherein said estimating unit calculates, based on printing data of the preceding sheet, a first length from said pair of conveyance rollers to the trailing edge of the preceding sheet, the first length corresponding to when printing of the preceding sheet ends, calculates, based on printing data of the succeeding sheet, a second length from said pair of conveyance rollers to the leading edge of the succeeding sheet, the second length corresponding to when the succeeding sheet is conveyed to the position facing said printing unit, and estimates whether or not the trailing edge of the preceding sheet will pass through said pair of conveyance rollers based on the calculated first length and second length.

20. The apparatus according to claim 11, wherein said conveyance control unit controls the conveyance of the printing sheet so as to form an overlap state where the trailing edge of the preceding sheet and the leading edge of the succeeding sheet are overlapped with each other between said feeding roller and said pair of conveyance rollers.

21. The apparatus according to claim 20, wherein in the overlap state the succeeding sheet is at a position on a side of said printing unit with respect to the preceding sheet.

22. The apparatus according to claim 20, further comprising:

a determination unit configured to determine whether to convey the succeeding sheet to a position facing said printing unit while keeping the overlap state or to convey the succeeding sheet to the position facing said printing unit after the overlap state has been cancelled.

23. The apparatus according to claim 22, further comprising an estimating unit configured to estimate whether or not the trailing edge of the preceding sheet will pass through said pair of conveyance rollers when the succeeding sheet conveyed by said pair of conveyance rollers reaches a start position of the printing operation by said printing unit, wherein when said estimating unit estimates that the trailing edge of the preceding sheet will not pass through said pair of conveyance rollers, said determination unit determines to convey the succeeding sheet to the position facing said printing unit after the overlap state has been cancelled.

* * * * *